US010709911B2

(12) United States Patent
Pavalarajan et al.

(10) Patent No.: US 10,709,911 B2
(45) Date of Patent: Jul. 14, 2020

(54) SURGICAL HELMET

(71) Applicant: Zimmer Surgical Inc., Dover, OH (US)

(72) Inventors: Ganesh B. Pavalarajan, Dover, OH (US); Christopher Fedele, Mentor, OH (US); Brian S. Schumacher, Orlando, FL (US); Sarah L. Lancianese, Orlando, FL (US)

(73) Assignee: Zimmer Surgical, Inc., Dover, OH (US)

( * ) Notice: Subject to any disclaimer, the term of this patent is extended or adjusted under 35 U.S.C. 154(b) by 351 days.

(21) Appl. No.: 14/038,855

(22) Filed: Sep. 27, 2013

(65) Prior Publication Data

US 2015/0090254 A1 Apr. 2, 2015

(51) Int. Cl.
*A62B 18/04* (2006.01)
*A42B 3/28* (2006.01)

(52) U.S. Cl.
CPC ..... *A62B 18/045* (2013.01); *A42B 3/286* (2013.01)

(58) Field of Classification Search
CPC ..... A42B 3/0493; A42B 3/08; A42B 3/28; A42B 3/286; A42B 3/288; A42B 3/227; A62B 18/045; A62B 18/04; A62B 7/00
See application file for complete search history.

(56) References Cited

U.S. PATENT DOCUMENTS 3,783,450 A 1/1974 Connor
3,793,644 A 2/1974 Kellner
3,925,821 A 12/1975 Lewicki
4,622,700 A 11/1986 Sundahl
4,901,716 A * 2/1990 Stackhouse ..... A41D 13/1153 128/201.25
4,995,117 A 2/1991 Mirage
5,010,598 A 4/1991 Flynn et al.
(Continued)

FOREIGN PATENT DOCUMENTS

EP 2853169 A1 4/2015
EP 2853169 B1 9/2016
(Continued)

OTHER PUBLICATIONS

"European Application Serial No. 14186411.6, Extended European Search Report dated Feb. 12, 2015", 7 pgs.
(Continued)

*Primary Examiner* — Rachel T Sippel
(74) *Attorney, Agent, or Firm* — Schwegman Lundberg & Woessner, P.A.

(57) ABSTRACT

A surgical helmet assembly including a ventilation system for circulating air around the head of a user. The surgical helmet assembly includes a surgical helmet including a brow bar to be positioned around the head of the user and a chin bar extending from the surgical helmet to be positioned in front of the chin of the user. The chin bar and brow bar include an airflow channel in fluid communication with a fan at the rear of the surgical helmet. The fan generates a flow of air from an airflow inlet at the rear of the surgical helmet through the airflow channel in the chin bar to an airflow outlet in the chin bar and past a user's face in an upward direction and through the airflow channel in the brow bar to an airflow outlet in the brow bar and upward over the user's head.

20 Claims, 17 Drawing Sheets

(56) References Cited

U.S. PATENT DOCUMENTS

| | | | | |
|---|---|---|---|---|
| 5,054,480 | A * | 10/1991 | Bare | A41D 13/11 128/201.25 |
| 5,577,495 | A * | 11/1996 | Murphy | A42B 3/225 128/201.22 |
| 6,081,929 | A | 4/2000 | Rothrock et al. | |
| 6,393,617 | B1 | 5/2002 | Paris et al. | |
| 6,427,253 | B1 | 8/2002 | Penny et al. | |
| 6,442,767 | B1 * | 9/2002 | Meckes | A42B 3/22 2/10 |
| 6,471,019 | B1 | 10/2002 | Miller | |
| 6,481,019 | B2 * | 11/2002 | Diaz | A41D 13/11 128/201.19 |
| 6,532,602 | B2 | 3/2003 | Watters et al. | |
| 6,711,748 | B2 | 3/2004 | Paris et al. | |
| 6,955,444 | B2 | 10/2005 | Gupta | |
| 6,973,677 | B2 | 12/2005 | Diaz et al. | |
| 6,990,691 | B2 | 1/2006 | Klotz et al. | |
| 7,192,151 | B2 | 3/2007 | Clupper et al. | |
| 7,200,873 | B2 | 4/2007 | Klotz et al. | |
| 7,694,353 | B2 | 4/2010 | Weston | |
| 7,752,682 | B2 | 7/2010 | VanDerWoude et al. | |
| 7,937,775 | B2 | 5/2011 | Manzella, Jr. et al. | |
| 8,156,570 | B1 * | 4/2012 | Hockaday | A41D 13/0025 2/7 |
| 8,196,224 | B2 | 6/2012 | Manzella, Jr. et al. | |
| 8,282,234 | B2 | 10/2012 | VanDerWoude et al. | |
| 8,819,869 | B2 | 9/2014 | Vanderwoude et al. | |
| 8,955,168 | B2 | 2/2015 | Manzella, Jr. et al. | |
| 9,173,437 | B2 | 11/2015 | Vanderwoude et al. | |
| 9,706,808 | B2 | 7/2017 | Sclafani et al. | |
| 10,037,754 | B1 | 7/2018 | Hollmann | |
| 10,384,084 | B2 | 8/2019 | Isham et al. | |
| 2001/0032348 | A1 | 10/2001 | Diaz et al. | |
| 2001/0046588 | A1 | 11/2001 | Sturtevant et al. | |
| 2005/0010992 | A1 | 1/2005 | Klotz et al. | |
| 2005/0109337 | A1 | 5/2005 | Diaz et al. | |
| 2005/0117327 | A1 | 6/2005 | Gupta | |
| 2006/0081262 | A1 | 4/2006 | Vega et al. | |
| 2006/0133069 | A1 * | 6/2006 | Clupper | A42B 3/044 362/106 |
| 2006/0213523 | A1 | 9/2006 | Vanderwoude et al. | |
| 2007/0000014 | A1 | 1/2007 | Rotella et al. | |
| 2007/0050898 | A1 | 3/2007 | Larson et al. | |
| 2007/0089221 | A1 | 4/2007 | Manzella, Jr. et al. | |
| 2008/0006278 | A1 | 1/2008 | Henke-sarmento et al. | |
| 2008/0155728 | A1 | 7/2008 | Hafer et al. | |
| 2008/0221705 | A1 | 9/2008 | Scussel | |
| 2008/0221706 | A1 | 9/2008 | Scussel et al. | |
| 2009/0151054 | A1 | 6/2009 | Vanderwoude et al. | |
| 2010/0294270 | A1 | 11/2010 | Curran et al. | |
| 2011/0004979 | A1 * | 1/2011 | VanDerWoude | A41D 13/1153 2/422 |
| 2011/0047668 | A1 | 3/2011 | Manzella, Jr. et al. | |
| 2011/0201982 | A1 | 8/2011 | Thompson | |
| 2012/0183786 | A1 | 7/2012 | Laroche et al. | |
| 2012/0216341 | A1 | 8/2012 | Manzella, Jr. et al. | |
| 2013/0327325 | A1 | 12/2013 | Vanderwoude et al. | |
| 2014/0273689 | A1 | 9/2014 | Carroll et al. | |
| 2014/0352037 | A1 | 12/2014 | Vanderwoude et al. | |
| 2016/0165999 | A1 | 6/2016 | Sclafani et al. | |
| 2018/0084848 | A1 | 3/2018 | Pavalarajan et al. | |
| 2018/0125127 | A1 | 5/2018 | Harris et al. | |
| 2018/0140450 | A1 | 5/2018 | Danek | |
| 2018/0220724 | A1 | 8/2018 | Bunn | |
| 2019/0111288 | A1 | 4/2019 | Isham et al. | |
| 2020/0001123 | A1 | 1/2020 | Vanderwoude et al. | |

FOREIGN PATENT DOCUMENTS

| | | | |
|---|---|---|---|
| GB | 2452490 | A | 3/2009 |
| WO | 2014031671 | A1 | 2/2014 |
| WO | WO-2014189364 | A1 | 11/2014 |
| WO | WO-2018057920 | A1 | 3/2018 |

OTHER PUBLICATIONS

"European Application Serial No. 14186411.6, Intention to grant dated Mar. 22, 2016", 1 pg.
"European Application Serial No. 14186411.6, Response filed Oct. 1, 2015 to Extended European Search Report dated Feb. 12, 2015", 13 pgs.
"European Application Serial No. 14186411.6, Decision to grant dated Aug. 19, 2016", 2 pgs.
"European Application Serial No. 16187934.1, Extended European Search Report dated Jan. 2, 2017".
"European Application Serial No. 16187934.1, Communication Pursuant to Article 94(3) EPC dated Dec. 8, 2017", 5 pgs.
"International Application Serial No. PCT/US2017/052995, International Search Report dated Nov. 29, 2017", 7 pgs.
"International Application Serial No. PCT/US2017/052995, Written Opinion dated Nov. 29, 2017", 9 pgs.
"European Application Serial No. 16187934.1, Response filed Aug. 8, 2017 to Extended European Search Report dated Jan. 2, 2017", 26pgs.
"European Application Serial No. 16187934.1, Response filed Apr. 20, 2018 to Office Action dated Dec. 8, 2017", 40 pgs.
"European Application Serial No. 16187934.1, Communication Pursuant to Article 94(3) EPC dated Aug. 10, 2018", 4 pgs.
"U.S. Appl. No. 15/332,389, Response filed Nov. 29, 2018 to Restriction Requirement dated Oct. 4, 2018", 7 pgs.
"U.S. Appl. No. 15/332,389, Restriction Requirement dated Oct. 4, 2018", 7 pgs.
"European Application Serial No. 16187934.1, Response filed Nov. 22, 2018 to Communication Pursuant to Article 94(3) EPC dated Aug. 10, 2018", 31 pgs.
"U.S. Appl. No. 15/332,389, Non Final Office Action dated Apr. 8, 2019", 6 pgs.
"U.S. Appl. No. 15/332,389, Response filed Jul. 8, 2019 to Non Final Office action dated Apr. 8, 2019", 10 pgs.
"U.S. Appl. No. 15/713,334, Non Final Office Action dated Jun. 28, 2019", 15 pgs.
"International Application Serial No. PCT/US2017/052995, International Preliminary Report on Patentability dated Apr. 4, 2019", 9 pgs.
"Turkey Application Serial No. 14186411.6, Office Action dated Jun. 24, 2019", 3 pgs.
"U.S. Appl. No. 15/713,334, Response filed Sep. 27, 2019 to Non-Final Office Action dated Jun. 28, 2019", 19 pgs.
"European Application Serial No. 17778146.5, Response to Communication pursuant to Rules 161(1) and 162 EPC filed Nov. 19, 2019", 14 pgs.
"U.S. Appl. No. 15/713,334, Notice of Allowance dated Feb. 12, 2020", 13 pgs.

* cited by examiner

SURGICAL HELMET

TECHNICAL FIELD

The disclosure is directed to a protective helmet for use in medical environments, such as surgical environments. More particularly, the disclosure is directed to a surgical helmet for use in surgical environments which provides ventilation airflow around a user's head.

BACKGROUND

Protective systems are used in medical environments, such as surgical environments, to provide a protective barrier between medical personnel and the operating field. For example, medical personnel may wear a protective system to protect themselves from airborne contaminants and/or bodily fluids during a medical procedure, such as a surgical procedure. For instance, medical personnel may wear a surgical helmet on their head, with a protective garment, such as a surgical shield and hood and/or toga supported by the surgical helmet and covering a portion of the medical personnel's head and/or body.

Accordingly, it is desirable to provide a protective system, such a surgical helmet, which provides a ventilation system to direct airflow around a user's head during use of the protective system to provide a comfortable environment for the user.

SUMMARY

The disclosure is directed to several alternative designs of a surgical helmet assembly and associated protective garments, and uses thereof.

Accordingly, one illustrative embodiment is a surgical helmet assembly. The surgical helmet assembly includes a surgical helmet to be worn on the head of a user. The surgical helmet includes an open cage structure positionable above the head of the user and a brow bar configured to extend around a forehead of the user. The surgical helmet assembly also includes a chin bar extending from the surgical helmet to be positioned in front of the chin of the user. The chin bar includes an airflow channel extending therethrough. The surgical helmet assembly further includes a ventilation system including an airflow inlet at the rear of the surgical helmet and a front airflow outlet in the chin bar configured to direct airflow out of the chin bar in an upward direction across a front portion of the user's face. A fan located at the rear of the surgical helmet generates a flow of air from the airflow inlet through the airflow channel in the chin bar to the airflow outlet and past a user's face in an upward direction. The ventilation system is configured to direct airflow exiting the surgical helmet through the open cage structure of the surgical helmet above the user's head.

Another illustrative embodiment is a surgical helmet assembly. The surgical helmet assembly includes a surgical helmet to be worn on the head of a user and a chin bar extending from the surgical helmet to be positioned in front of the chin of the user. The surgical helmet includes an open cage structure positionable above the head of the user and a brow bar configured to extend around a forehead of the user. The brow bar includes an airflow channel defined therein. The chin bar also includes an airflow channel defined therein. The surgical helmet assembly further includes a ventilation system including a fan located in a rear of the surgical helmet, an airflow inlet at the rear of the surgical helmet, at least one airflow front outlet in the chin bar configured to direct airflow out of the chin bar in an upward direction across the user's face, and at least one airflow outlet in the brow bar configured to direct airflow out of the brow bar in an upward direction over the user's head. The fan generates a flow of air from the airflow inlet through the airflow channel in the chin bar to the airflow outlet in the chin bar and across a user's face in an upward direction and through the airflow channel in the brow bar to the airflow outlet in the brow bar and over the user's head in an upward direction. The ventilation system is configured to direct the flow of air to exit the surgical helmet through the top of the surgical helmet above the user's head. Directing the airflow upward across the user's face and out the top of the helmet allows fresh air to be continuously circulated around the user's face while wearing the helmet assembly and associated protective garment during a surgical procedure. The helmet may include an open lattice framework or cage positioned above the user's head permitting airflow up and out of the helmet in an upward direction through the openings in the open lattice framework or cage above the user's head.

Yet another illustrative embodiment is a surgical helmet assembly. The surgical helmet assembly includes a surgical helmet to be worn on the head of a user and a chin bar extending from the surgical helmet to be positioned in front of the chin of the user. The surgical helmet includes an open cage structure positionable above the head of the user and a brow bar configured to extend around a forehead of the user. The brow bar includes an airflow channel defined therein. The chin bar also includes an airflow channel defined therein. The surgical helmet assembly further includes a ventilation system including a fan located at a rear of the surgical helmet, an airflow inlet at the rear of the surgical helmet, at least one airflow front outlet in the chin bar configured to direct airflow out of the chin bar in an upward direction across the user's face, at least one airflow outlet in the brow bar configured to direct airflow out of the brow bar in an upward direction over the user's head, and first and second airflow side outlets on opposing sides of the chin bar configured to direct airflow out of the chin bar upward past the user's cheeks. The fan generates a flow of air from the airflow inlet through the airflow channel in the chin bar to the at least one airflow front outlet, the at least one airflow outlet in the brow bar, and the first and second airflow side outlets. The ventilation system is configured to direct the flow of air upward over the user's head to exit the surgical helmet through the open cage structure.

The above summary of some example embodiments is not intended to describe each disclosed embodiment or every implementation of the aspects of the disclosure.

BRIEF DESCRIPTION OF THE DRAWINGS

The aspects of the disclosure may be more completely understood in consideration of the following detailed description of various embodiments in connection with the accompanying drawings, in which.

Figure 1:
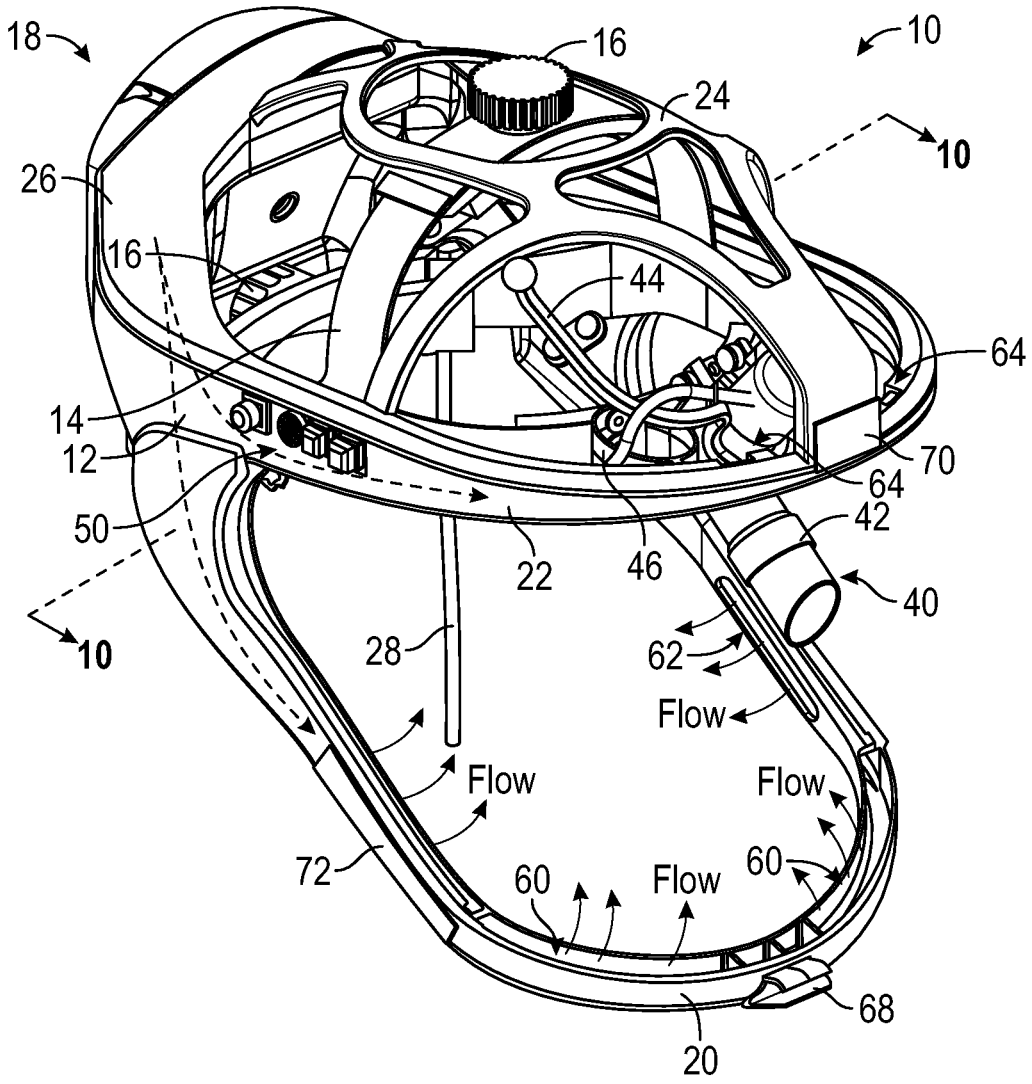
FIG. 1 is a perspective view toward the right side of an exemplary surgical helmet assembly.

While the aspects of the disclosure are amenable to various modifications and alternative forms, specifics thereof have been shown by way of example in the drawings and will be described in detail. It should be understood, however, that the intention is not to limit aspects of the disclosure to the particular embodiments described. On the contrary, the intention is to cover all modifications, equivalents, and alternatives falling within the spirit and scope of the disclosure.

DETAILED DESCRIPTION

For the following defined terms, these definitions shall be applied, unless a different definition is given in the claims or elsewhere in this specification.

All numeric values are herein assumed to be modified by the term "about", whether or not explicitly indicated. The term "about" generally refers to a range of numbers that one of skill in the art would consider equivalent to the recited value (i.e., having the same function or result). In many instances, the term "about" may be indicative as including numbers that are rounded to the nearest significant figure.

The recitation of numerical ranges by endpoints includes all numbers within that range (e.g., 1 to 5 includes 1, 1.5, 2, 2.75, 3, 3.80, 4, and 5).

Although some suitable dimensions, ranges and/or values pertaining to various components, features and/or specifications are disclosed, one of skill in the art, incited by the present disclosure, would understand desired dimensions, ranges and/or values may deviate from those expressly disclosed.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

The following detailed description should be read with reference to the drawings in which similar elements in different drawings are numbered the same. The detailed description and the drawings, which are not necessarily to scale, depict illustrative embodiments and are not intended to limit the scope of the disclosure. The illustrative embodiments depicted are intended only as exemplary. Selected features of any illustrative embodiment may be incorporated into an additional embodiment unless clearly stated to the contrary.

Various views of an exemplary surgical helmet assembly 10 are illustrated in FIGS. 1-7. The surgical helmet assembly 10 may be used by medical personnel in medical environments, such as surgical environments, to support a protective shield and/or a protective garment worn on the user's head and/or body. In some instances, the surgical helmet assembly 10 may provide ventilation airflow around a user's head while wearing the surgical helmet assembly 10 and associated protective shield and/or protective garment.

As used herein, the terms "top", "bottom", "front", "rear", "left", "right", and "lateral side" are used to refer to portions of the surgical helmet assembly 10 in an orientation in which the surgical helmet assembly 10 is positioned on a user's head.

The surgical helmet assembly 10 may include a helmet 12 shaped and configured to be placed around a user's head. The helmet 12 may extend around the user's head, for example, with an open cage or open lattice framework 24 of the helmet 12 positioned above the user's head. As will be discussed later herein, the open lattice framework or open cage 24 may permit airflow up and out of the helmet 12 in an upward direction through the openings in the open lattice framework or open cage 24. Furthermore, the open lattice framework or cage 24 minimizes the overall weight and helmet structure above the user's head, reducing stresses and/or fatigue while wearing the helmet assembly 10 during a surgical procedure.

The helmet 12 may include a rear portion 26 positioned at the rear of the helmet 12 configured to be positioned at the rear of the user's head when worn. A fan 32 and associated motor 34 for powering the fan 32 (shown in FIG. 8), may be located at the rear of the helmet 12 to generate a flow of air around a user's head while wearing the surgical helmet assembly 10. The helmet 12 may include an inlet cover 18 at the rear of the helmet 12 to access the fan 32 and/or motor 34 in the helmet 12. In another example, the fan 32 and/or motor 34 may be located on top of the helmet 12. In yet another example, the fan 32 and/or motor 34 may be separate from the helmet 12, and may be carried on a user's back or at a user's waist, for example. The helmet 12 may also include a brow bar 22 at the front of the helmet 12 configured to be positioned around the user's brow or forehead when worn.

The helmet 12, which may be formed of one or more components, may be formed of any desired material(s), such as polymer materials. For example, the helmet 12 may be formed of a plurality of molded plastic materials secured together. In some instances, the helmet 12 may include a top piece including the open lattice framework or open cage 24, a top portion of the rear portion 26 and a top portion of the brow bar 22; and a bottom piece, or helmet base, including a bottom portion of the rear portion 26 and a bottom portion of the brow bar 22, for example. The helmet 12 may also include a rear cover 18, which in some instances may be removable to access the fan 32 and motor 34 in the helmet 12.

The helmet assembly 10 may also include an adjustable head band 14 configured to be positioned around the user's head to support the helmet assembly 10 on a user's head. The adjustable head band 14 may be adjustable to fit various head sizes. For example, the adjustable head band 14 may include a first adjustment knob 16 for adjusting the circumference or length of the strap of the adjustable head band 14 extending around the user's head to closely match the circumference of the user's head, to the liking of the user. The adjustable head band 14 may also include a second adjustment knob 16 for adjusting the length of the strap of the adjustable head band 14 extending over the user's head from a first side of the helmet 12 to an opposite second side of the helmet 12. Adjustments to the adjustable head band 14 using the adjustment knobs 16 may be made by the user to provide a comfortable fit.

Figure 6:
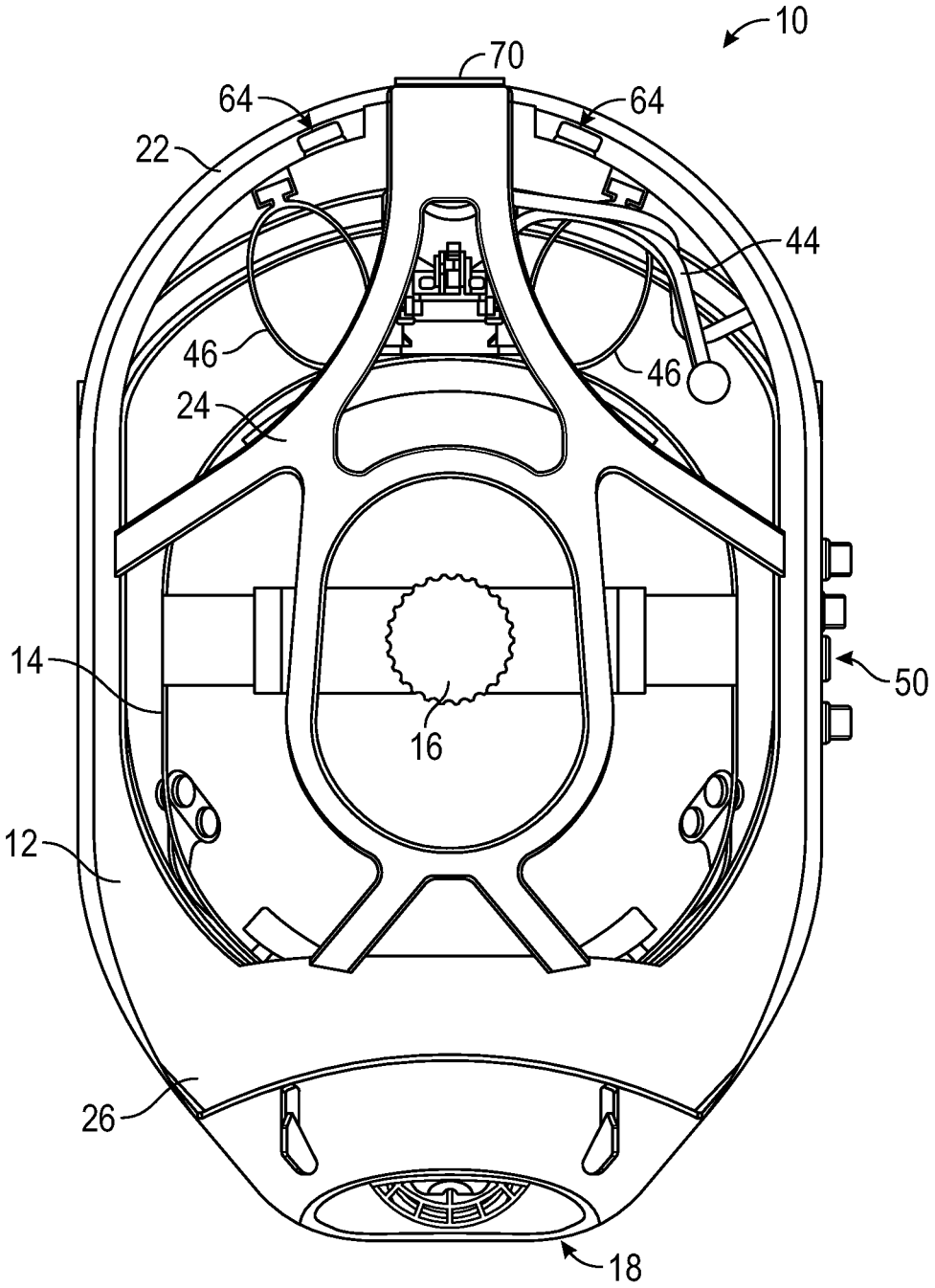
FIG. 6 is a top view of the surgical helmet assembly of FIG. 1.
Figure 7:
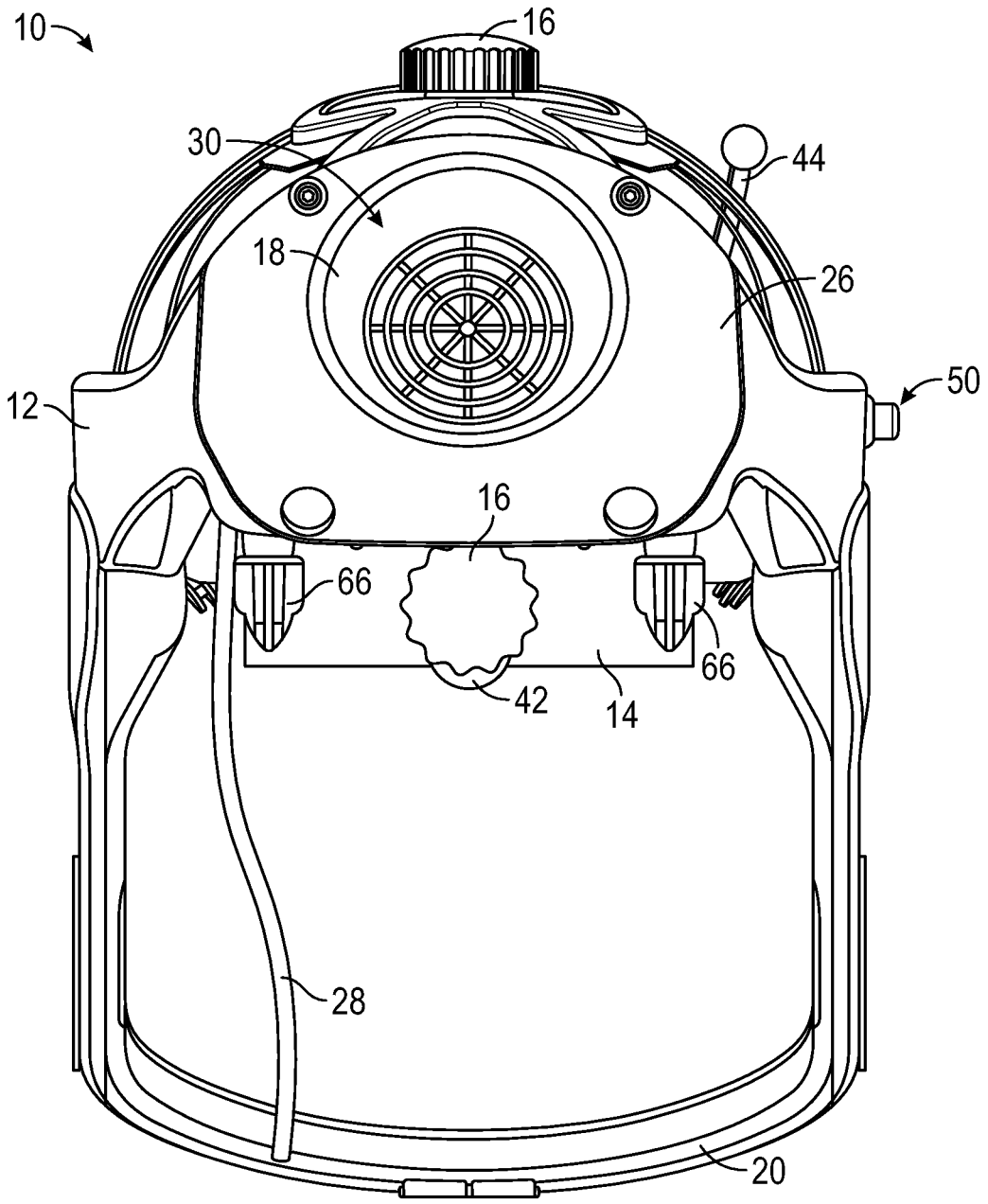
FIG. 7 is rear view of the surgical helmet assembly of FIG. 1.

The adjustable head band 14 may be positioned within the helmet 12 and supported therein by a plurality of supports. For example, a plurality of supports 46 (shown in FIG. 6), such as flexible members, may extend between the adjustable head band 14 and the helmet 12 to secure the adjustable head band 14 within the helmet 12. It is noted that although two supports 46 are illustrated in FIG. 6 at the front of the helmet assembly 10, one or more additional supports 46 may also be located at the rear of the helmet assembly 10, such as two spaced apart supports located on either side of the rear portion 26, or at another location, if desired. The supports 46 may maintain the helmet 12 spaced away from the adjustable head band 14 and provide a degree of movement between the helmet 12 and the adjustable head band 14.

In some instances, the helmet assembly 10 may also include an optional light assembly 40 including a light source 42 to illuminate a surgical field for the user while wearing the helmet assembly 10. The light source 42 may be one or more light-emitting diodes (LEDs), an incandescent light bulb, or a fiber optic light source, for example. The light assembly 40 may include a common adjustment mechanism, such as a lever 44 (e.g., adjustment arm) which the user may actuate to adjust the angle of the light emitted from the light source 42. For example, the light source 42 may be mounted to a housing of the light assembly 40, which may be pivoted at a linkage coupling the housing of the light assembly to the cage 24, for example, by actuating the lever 44 between a first position and a second position, shown in FIG. 3. The light assembly 40 may include a fan (not shown) positioned in the housing of the light assembly 40, for example, to cool the light source 42 during use. Lever 44 can comprise a first user-interface for operating the helmet assembly 10.

Figure 3:
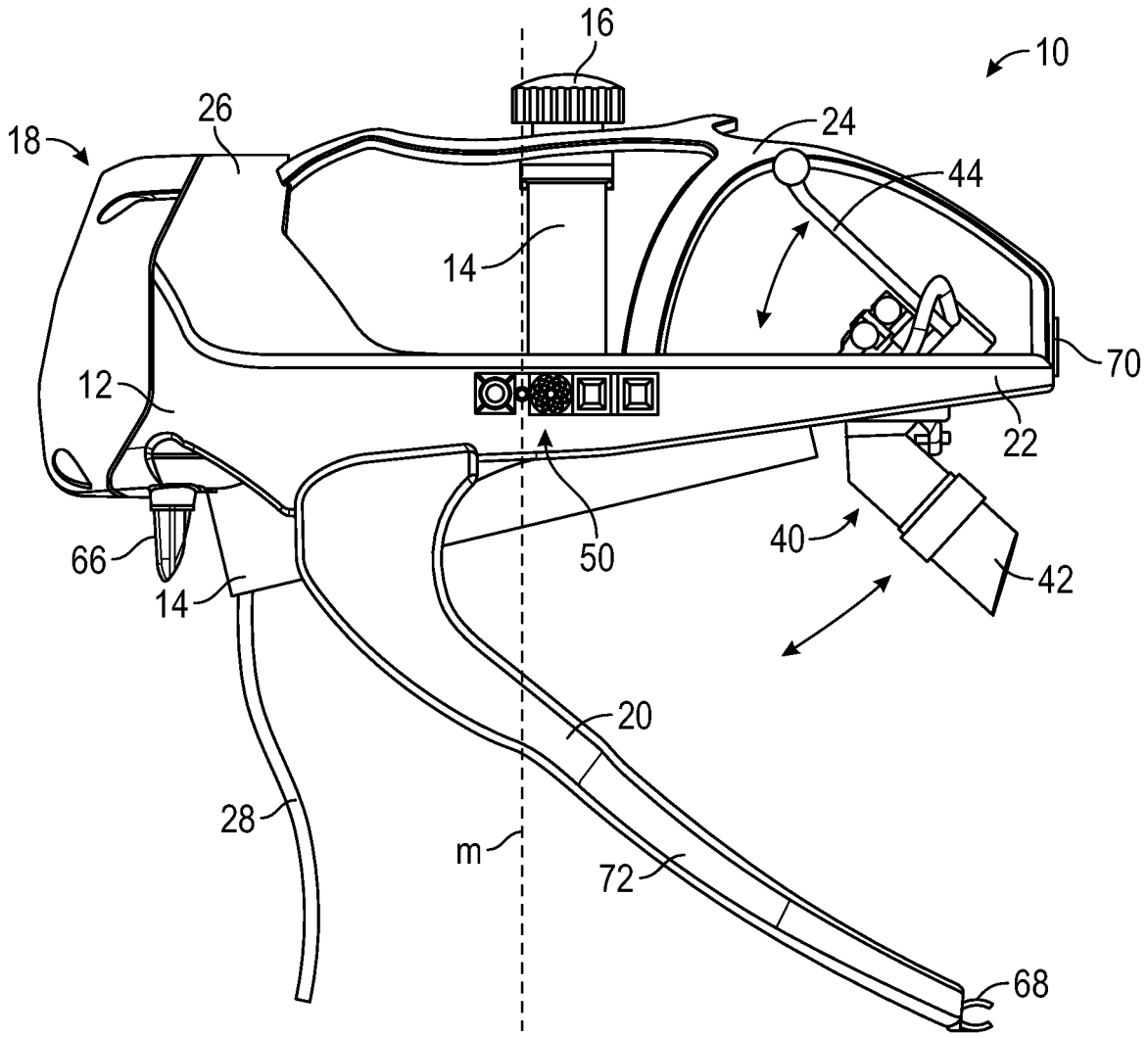
FIG. 3 is a side view of the right side of the surgical helmet assembly of FIG. 1.
Figure 4:
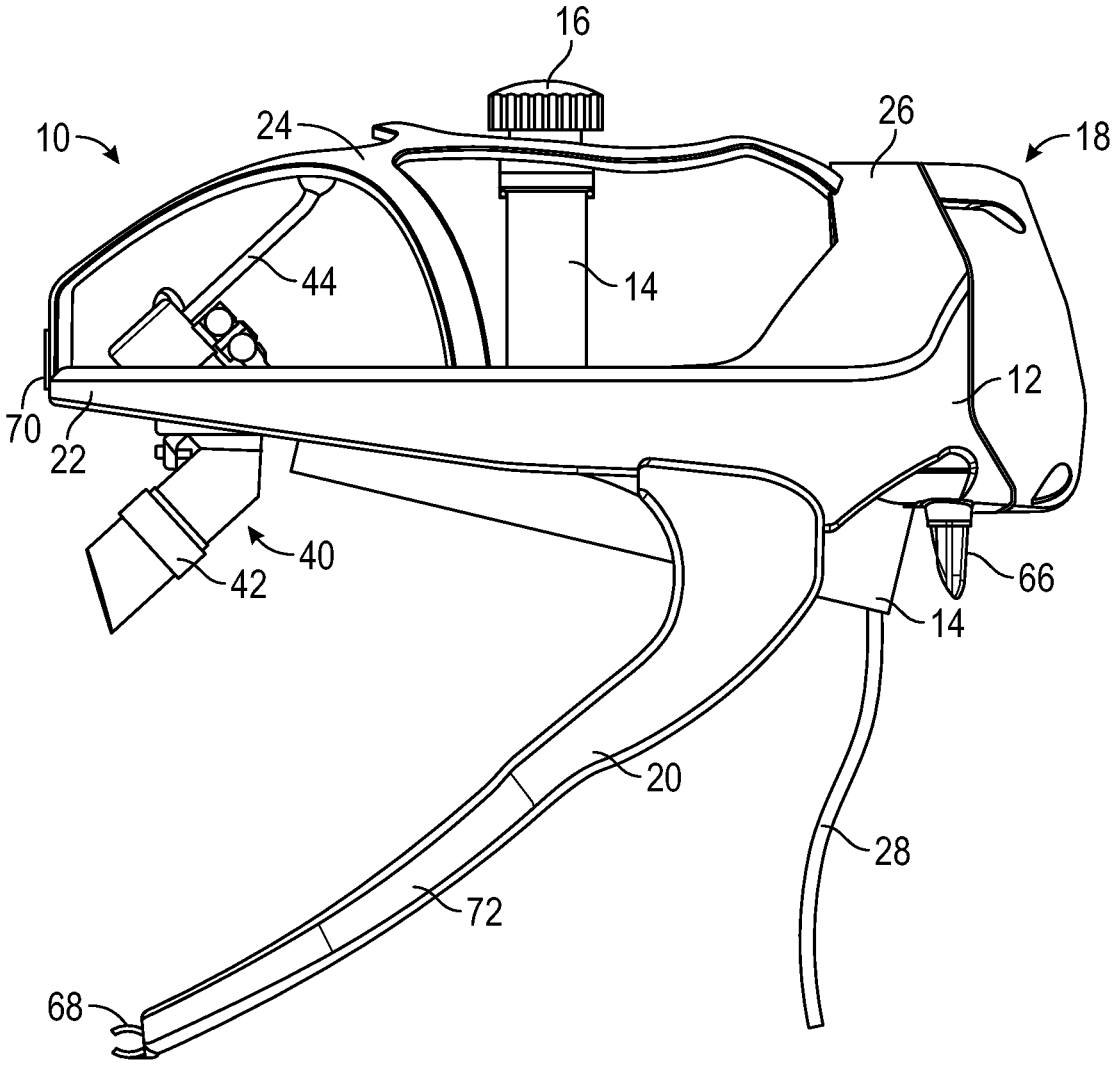
FIG. 4 is a side view of the left side of the surgical helmet assembly of FIG. 1.
Figure 5:
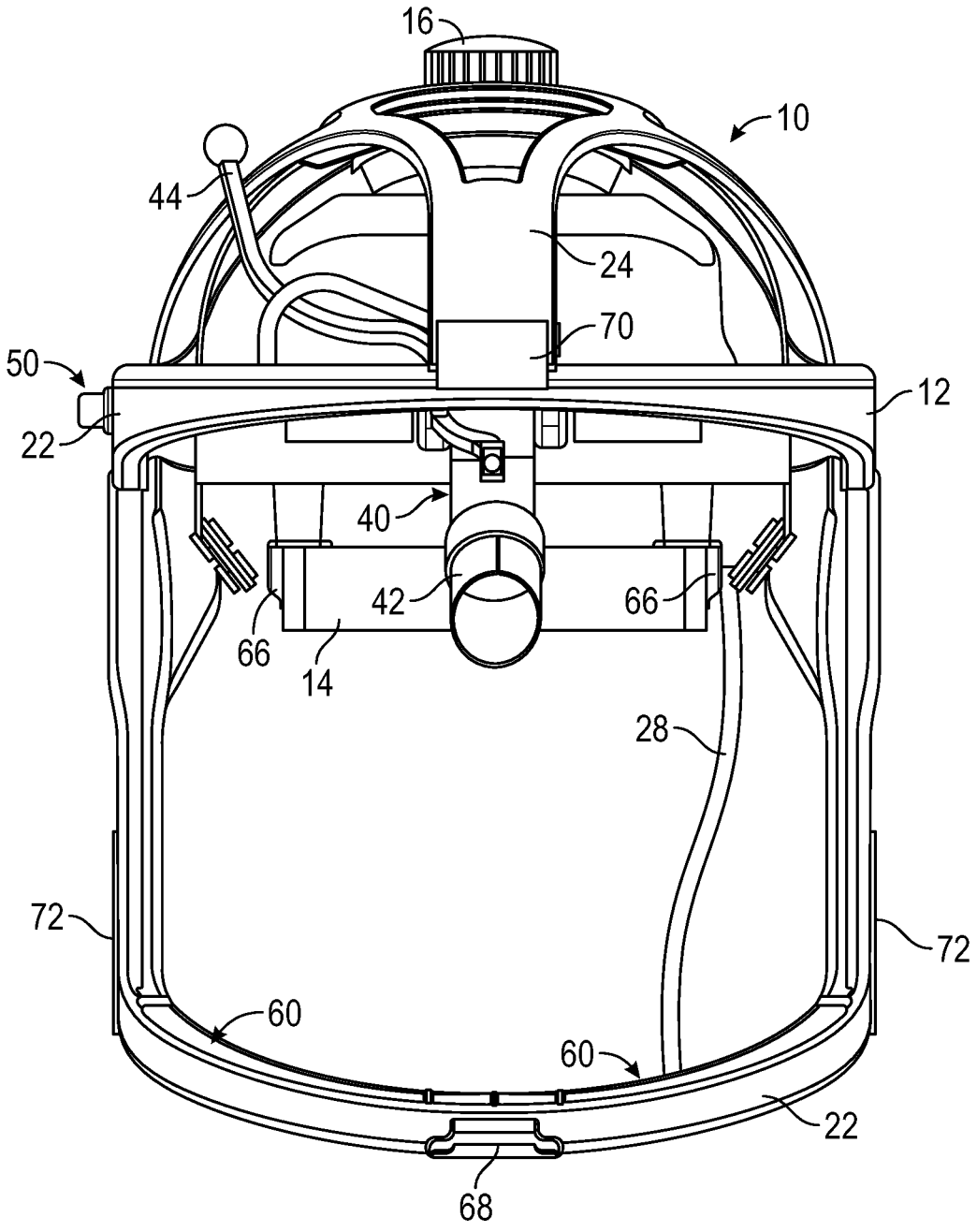
FIG. 5 is a front view of the surgical helmet assembly of FIG. 1.

The helmet assembly 10 may include a control module 50 for controlling the fan 32 and/or light assembly 40. The control module 50 may be positioned at any location on the helmet 12 or other component of the helmet assembly 10. For example, as shown in FIG. 3, the control module 50 may be positioned on a later side of the helmet 12, such as the right side of the helmet 12. However, in other instances, the control module 50 may be positioned at the rear of the helmet 12, or at another location on the helmet assembly 10, if desired. Electrical power may be supplied to the motor 34 to run the fan 32 and/or the light assembly 40 through electrical wiring 28 extending from a power source, such as a battery (not shown). In other instances, the light assembly 40 may include a separate internal power source, e.g., a battery, within the housing of the light assembly 40, or located elsewhere on the helmet assembly 10. Control module 50 can comprise a second user-interface for operating the helmet assembly 10.

Figure 13:
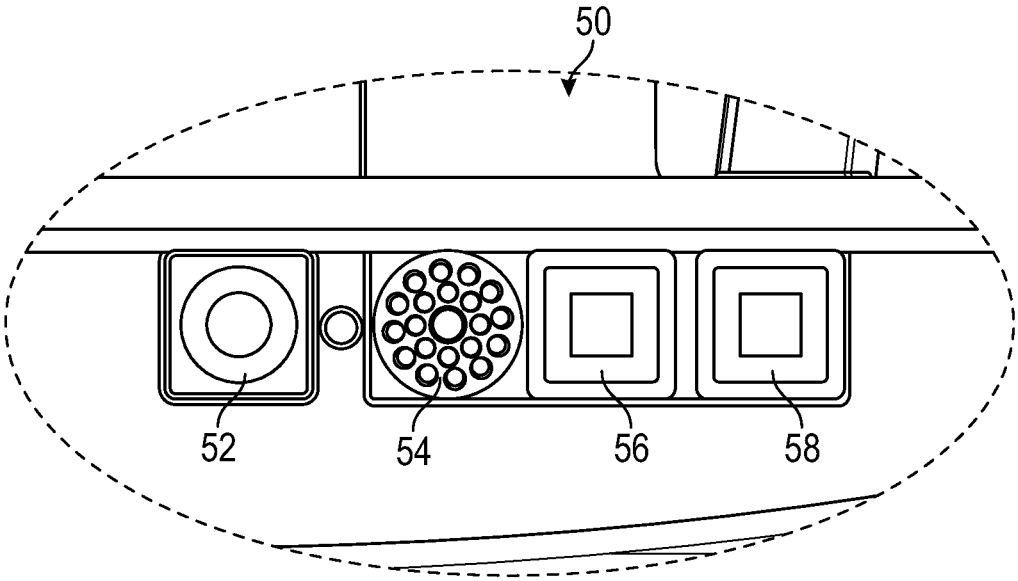
FIG. 13 is an enlarged view of a control module of the surgical helmet assembly of FIG. 1.

FIG. 13 is an enlarged view of the control module 50. The control module 50 may include a first button 58, such as a push button or other switch, configured to increase the speed of the fan 32 when depressed and a second button 56, such as a push button or other switch, configured to decrease the speed of the fan 32 when depressed. For example, the motor 34 may be able run the fan 32 at multiple speeds to provide a desired airflow rate. The control module 50 may include electrical circuitry to control the speed of the motor 34. Accordingly, depressing the first button 58 may generate a signal to the circuitry to increase the speed of the fan 32 by providing an increase in the amount of current, voltage or power supplied to the motor 34, whereas depressing the second button 56 may generate a signal to the circuitry to decrease the speed of the fan 32 by providing a decrease in the amount of current, voltage or power supplied to the motor 34. In some exemplary embodiments, the fan 32 may have a fan speed sequence as follows: (off-speed 1-speed 2-speed 3-speed 4-speed 5-speed 6), (off-speed 1-speed 2-speed 3-speed 4-speed 5), (off-speed 1-speed 2-speed 3-speed 4), (off-speed 1-speed 2-speed 3), (off-low-medium-high), (off-low-high), (off-high-medium-low), (off-high-low). Accordingly, each time the first button 58 is depressed, the fan speed is changed to the next incremental setting in the sequence and each time the second button 56 is depressed, the fan speed is changed to the previous incremental setting in the sequence. In some embodiments, the fan 32 may automatically turn on when the helmet assembly 10 is connected to a power source. For example, the fan 32 may automatically turn on to the slowest fan speed when the helmet assembly 10 is connected to a power source. Accordingly, in some exemplary embodiments in which the fan is automatically turned on when the helmet assembly 10 is connected to a power source, the fan 32 may have a fan speed sequence as follows: (speed 1-speed 2-speed 3-speed 4-speed 5-speed 6), (speed 1-speed 2-speed 3-speed 4-speed 5), (speed 1-speed 2-speed 3-speed 4), (speed 1-speed 2-speed 3), (low-medium-high), (low-high), (high-medium-low), (high-low).

In some instances, the buttons or switches for controlling the speed of the fan 32 (e.g., the first and second buttons 58, 56) on the control module 50 may be positioned on the side of the helmet 12 forward of (i.e., toward the front of the helmet 12) the midplane M shown in FIG. 3. The midplane M may be a plane located equidistant between the front and rear of the helmet 12 extending parallel to the coronal plane of the user. Thus, the midplane M may divide the helmet 12 into a front portion (e.g., front half) and a rear portion (e.g., rear half).

In embodiments including the light assembly 40, the control module 50 may also include a third button 52, such as a push button or other switch, configured to turn the light source 42 on and/or off. For example, depressing the third button 52 a first time may turn the light source 42 (and fan, if included) on, and depressing the third button 52 a second time may turn the light source 42 off. In some instances, the light source 42 may have multiple light intensity settings, such that pushing the third button 52 a first time turns the light source 42 on at a first light intensity. Pushing the third button 52 one or more subsequent times may increase and/or decrease the intensity of the light source 42 to one or more additional intensity settings. Pushing the third button 52 one more time may then turn the light source 42 off. In some exemplary embodiments, the light assembly 40 may have a lighting sequence as follows: (off-low-medium-high-off), (off-low-high-off), (off-high-medium-low-off), (off-high-low-off), or (off-on-off). Accordingly, each time the button 52 is depressed, the light source 42 is changed to the next setting in the sequence. In some embodiments, the light source 42 may automatically turn on when the helmet assembly 10 is connected to a power source. Accordingly, in some exemplary embodiments in which the light source 42 is automatically turned on when the helmet assembly 10 is connected to a power source, the light assembly 40 may have a lighting sequence as follows: (low-medium-high-off), (low-high-off), (high-medium-low-off), (high-low-off), or (on-off).

In some instance, the control module 50 may include a speaker 54 for generating a tone (e.g., an audible tone) when one of the buttons 52, 56, 58 is depressed to provide the user with feedback in a manner similar to many devices used in and outside the medical products field that include multiple speed settings. For example, in some instances, the control module 50 may generate a first tone at a first frequency and/or volume when the first button is depressed, a second tone at a second frequency and/or volume when the second button is depressed, and a third tone at a third frequency and/or volume when the third button is depressed. Each of the first, second and third frequencies and/or volumes may be different, thus providing differential feedback to the user regarding the operation of the fan 32 and/or the light assembly 40. For example, the first frequency and/or volume may be higher than the second frequency and/or volume, and the second frequency and/or volume may be higher than the third frequency and/or volume, in some instances. In other instances, the first frequency and/or volume may be lower than the second frequency and/or volume, and the second frequency and/or volume may be lower than the third frequency and/or volume. In one illustrative embodiment, the first frequency may be in the range of about 4 to about 6 kHz, or about 4.46 kHz, the second frequency may be in the range of about 2 to about 3 kHz, or about 2.4 kHz, and the third frequency may be in the range of about 1 to about 1.5 kHz, or about 1.11 kHz for example.

In some instances, an audible tone may not be generated (e.g., an inaudible tone may be generated or no tone may be generated) when the fan speed is turned to the off position and/or when the fan 32 is turned to the highest fan speed. For instance, in some embodiments, a tone at the first frequency and/or volume may be generated as the fan speed is increased from "off" to each successive fan speed, up to the next-to-highest fan speed, but not including the highest fan speed. Furthermore, a tone at the second frequency and/or volume may be generated as the fan speed is decreased to each successive fan speed from the highest fan speed down to the lowest fan speed, without generating a tone at the second frequency and/or volume as the fan speed is decreased from the lowest fan speed to "off". Alternatively, a tone at the second frequency and/or volume may be generated as the fan speed is decreased to each successive fan speed from the highest fan speed down toward the lowest fan speed, without generating a tone at the second frequency and/or volume as the fan speed is decreased to the lowest fan speed.

In other instances, an audible tone may not be generated (e.g., an inaudible tone may be generated or no tone may be generated) when the first button 58 (i.e., the increase fan speed button) is pushed when the fan 32 is already at the highest fan speed and/or when the second button 56 (i.e., the decrease fan speed button) is pushed when the fan 32 is already at the lowest fan speed (e.g., in embodiments in which the fan 32 does not include an "off" position). For instance, in some embodiments, a tone at the first frequency and/or volume may be generated as the fan speed is increased from the lowest fan speed (or "off" position, if provided) to each successive fan speed, up to and including the highest fan speed, however, a tone at the first frequency and/or volume may not be generated when the first button 58 (i.e., the increase fan speed button) is subsequently pushed when the fan 32 has already reached the highest fan speed. Furthermore, a tone at the second frequency and/or volume may be generated as the fan speed is decreased to each successive fan speed from the highest fan speed down to the lowest fan speed, however, a tone at the second frequency and/or volume may not be generated when the second button 56 (i.e., the decrease fan speed button) is subsequently pushed when the fan 32 has already reached the lowest fan speed.

In some embodiments, the control module 50 may include circuitry to monitor the power level of the battery used to power the fan 32 and/or light assembly 40. In some instances, the control module 50 may generate a fourth tone (e.g., an audible tone) at a fourth frequency and/or volume when the power level of the battery has decreased below a predetermined level, thus indicating a low battery. The fourth frequency and/or volume may be deferent than the first, second and third frequencies and/or volumes, such that the low battery tone is distinguishable from the other tones. For example, the fourth frequency may be in the range of about 0.4 kHz to about 0.7 kHz, or about 0.52 kHz, in some instances.

Figure 17:
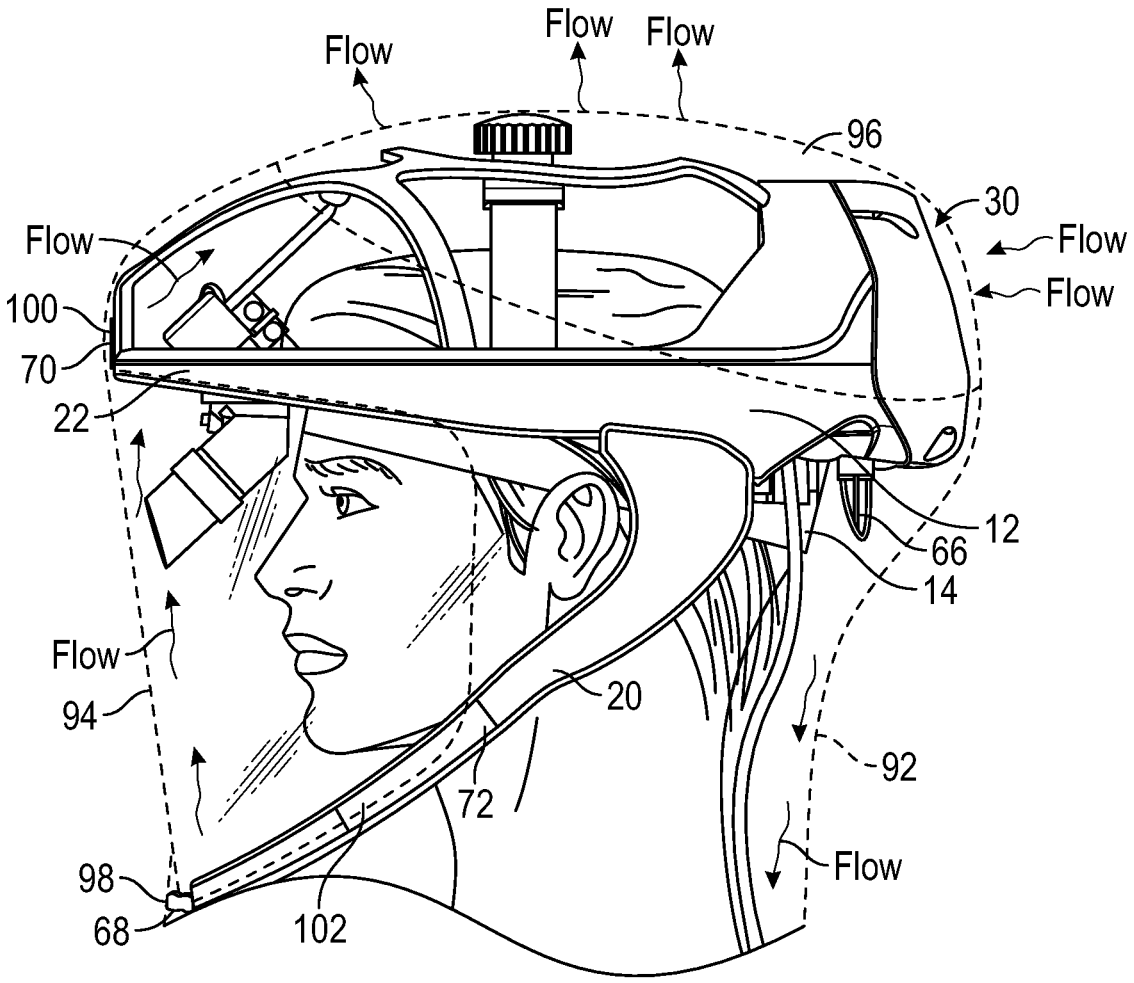

The helmet assembly 10 may also include a chin bar 20 extending from the surgical helmet 12 to be positioned in front of the chin of the user. In some instances, the chin bar 20 may be a unitary portion of the helmet 12, or the chin bar 20 may be a separate component attached to the helmet 12. The chin bar 20 may be configured to help support a shield attached to the helmet assembly 10, as will be further discussed herein. The chin bar 20 may have a first end extending from the helmet 12 and located on a first side of the helmet 12, and a second end extending from the helmet 12 and located on a second side of the helmet 12, such that the chin bar 20 has a generally U-shape configured to extend around the chin of the user, with opposing side portions of the chin bar 20 generally facing the cheeks of the user's head. As shown in FIG. 17, the first and second ends of the chin bar 20 may extend from the helmet 12 at a location behind the ears of the user (i.e., to the rear of the ears of the user). Accordingly, the chin bar 20 may extend from the surgical helmet 12 at a location rearward of the user's ears such that the chin bar 20 does not obstruct sound from traveling to the user's ears and/or increases the field of vision for the user, for example. Alternatively, the chin bar 20 may extend from the helmet 12 at a location in front of the ears of the user, or may be otherwise configured to leave the ears of the user uncovered, if desired.

Figure 8:
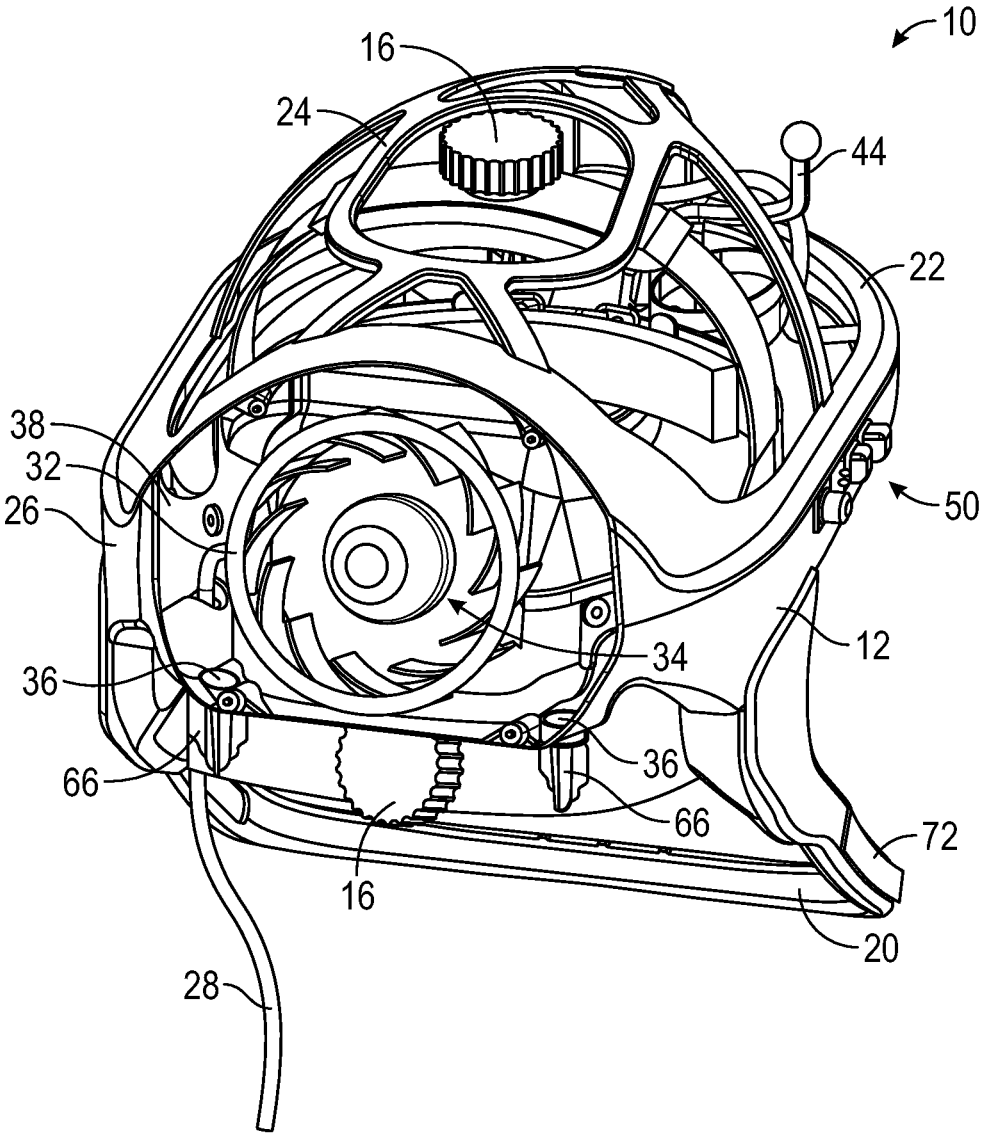
FIG. 8 is a perspective view toward the rear of the surgical helmet assembly of FIG. 1 with a rear cover of the helmet removed.

The helmet assembly 10 may include a ventilation system configured to provide airflow through the helmet 12 and around the user's head. For instance, the ventilation system may include the fan 32 and motor 34 positioned at the rear of the helmet 12, as shown in FIG. 8. The rear of the helmet 12 may define an inflow air chamber 38 surrounding the fan 32 or otherwise in fluid communication with the fan 32. The ventilation system may also include an airflow inlet 30, shown in FIG. 7, opening into the inflow air chamber 38

(shown in FIG. 8) at the rear of the helmet 12. The airflow inlet 30 may allow ambient air to be drawn into the inflow air chamber 38 by the fan 32 during use. The fan 32 may then blow the air through airflow channels in the helmet 12 to circulate the air around the user's head as will be described herein.

The ventilation system may include one or more, or a plurality of airflow outlets arranged with the helmet assembly 10 to direct a flow of air around a user's head while wearing the helmet assembly 10. For instance, the ventilation system may include one or more, or a plurality of chin bar airflow front outlets 60 located at a front portion of the chin bar 20 configured to direct airflow out of the chin bar 20 and past the user's face. For instance, the chin bar airflow front outlets 60, which may include openings facing an upward direction, may be configured to direct airflow out of the chin bar 20 in an upward direction in front of and over the user's face. In the illustrated embodiment (see, for example, FIGS. 1 and 2), the chin bar 20 may include first and second spaced apart chin bar airflow front outlets 60, with a partition located between the first and second spaced apart chin bar airflow front outlets 60. However, in other instances, the chin bar 20 may include a single airflow front outlet, or another arrangement of airflow front outlets, if desired.

The ventilation system may also include one or more, or a plurality of chin bar airflow side outlets 62 located on the side portions of the chin bar 20 configured to direct airflow out of the chin bar 20 and past the sides of the user's head, such as the user's cheeks. For instance, the chin bar 20 may include a first chin bar airflow side outlet 62 positionable on a first side of the user's head, and a second chin bar airflow outlet 62 positionable on a second side of the user's head. The chin bar airflow side outlets 62, which may include openings facing inward toward the sides of the user's head, may be configured to direct airflow out of the chin bar 20 toward the user's cheeks.

The ventilation system may also include one or more, or a plurality of brow bar airflow outlets 64 located at a front portion of the brow bar 22 configured to direct airflow out of the brow bar 22 over the user's head (see, for example, FIG. 6). For instance, the brow bar airflow outlets 64, which may include openings facing an upward direction, may be configured to direct airflow out of the brow bar 22 in an upward direction over the user's forehead. In the illustrated embodiment (see, for example, FIGS. 1 and 2), the brow bar 22 may include first and second spaced apart brow bar airflow outlets 64, with a partition located between the first and second spaced apart brow bar airflow outlets 64. However, in other instances, the brow bar 22 may include a single airflow outlet, or another arrangement of airflow outlets, if desired.

The ventilation system may also include one or more, or a plurality of rear airflow outlets, such as nozzles 66, located at the rear of the helmet assembly 10 configured to direct airflow toward the rear of the user's neck. For instance, the nozzles 66, which may be directed in a downward direction from the helmet 12, may be configured to direct airflow out of the inflow air chamber 38 in a downward direction toward the nape of the user's neck. As shown in FIG. 8, the helmet assembly 10 may include airflow openings 36 providing fluid communication from the inflow air chamber 38 to the rear nozzles 66 to direct airflow from the inflow air chamber 38 to the rear nozzles 66 with the fan 32.

Figure 9:
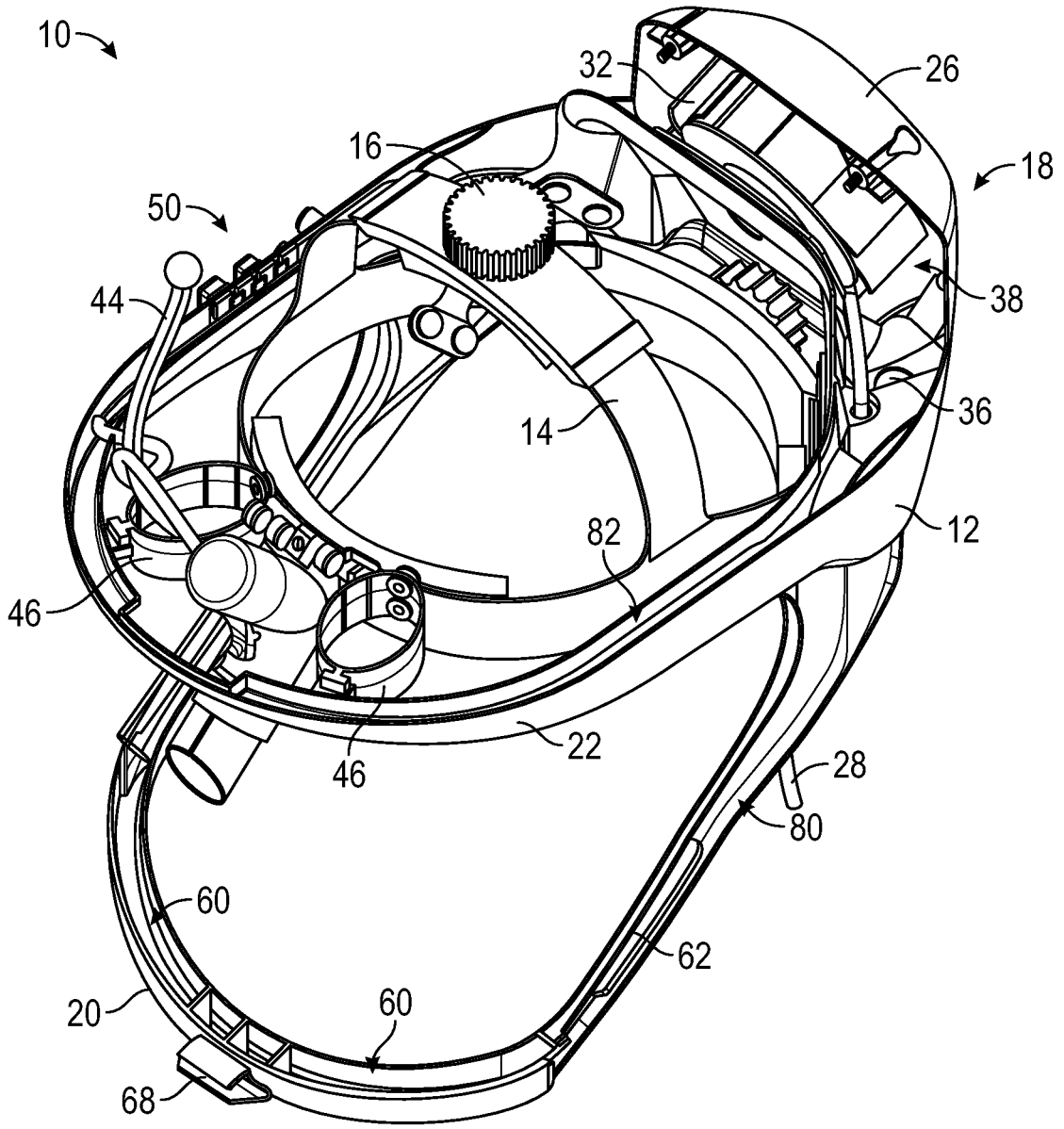
FIG. 9 is perspective view of the surgical helmet assembly of FIG. 1 with portions of the surgical helmet assembly removed to show interior airflow passages through components of the surgical helmet assembly.

The ventilation system may include airflow passages through components of the helmet assembly 10 providing fluid communication between the inflow air chamber 38 at the rear of the helmet 12 and the airflow outlets 60, 62, 64 in the chin bar 20 and/or the brow bar 22 for routing airflow to the various airflow outlets. FIG. 9, which is a perspective view of the surgical helmet assembly 10 of FIG. 1 with portions of the surgical helmet assembly 10 removed, illustrates exemplary interior airflow passages through components of the surgical helmet assembly 10. Furthermore, FIG. 10, which is a cross-sectional view of the surgical helmet assembly 10 of FIG. 1, further illustrates exemplary interior airflow passages through components of the surgical helmet assembly 10.

Figure 10:
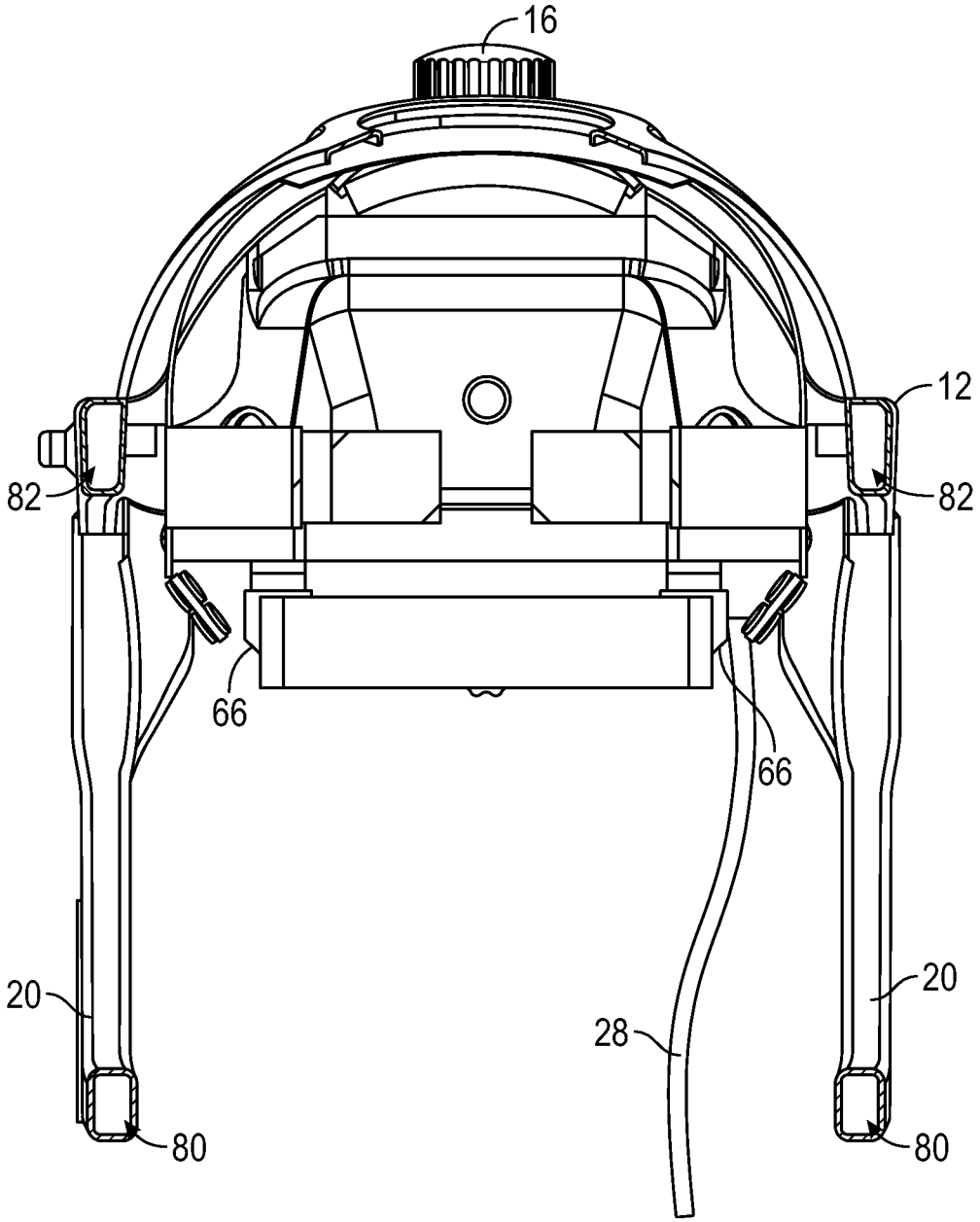
FIG. 10 is a cross-sectional view taken along line 10-10 of the surgical helmet assembly of FIG. 1 illustrating interior airflow passages through components of the surgical helmet assembly.

As shown in FIGS. 9 and 10, the brow bar 22 may include an airflow passage or channel 82 extending through the interior of the brow bar 22. The airflow passage 82 may provide fluid communication between the inflow air chamber 38 at the rear of the helmet 12 and the brow bar airflow outlets 64 at the front portion of the brow bar 22. Accordingly, the fan 32 may blow air through the airflow passage 82 defined through the interior of the brow bar 22 to the brow bar airflow outlets 64 and up over the user's head.

Furthermore, as shown in FIGS. 9 and 10, the chin bar 20 may include an airflow passage or channel 80 extending through the interior of the chin bar 20. The airflow passage 80 may provide fluid communication between the inflow air chamber 38 at the rear of the helmet 12 and the front and side chin bar airflow outlets 60, 62. Accordingly, the fan 32 may blow air through the airflow passage 80 defined through the interior of the chin bar 20 to the chin bar airflow side outlets 62 and toward the sides of the user's head, and to the chin bar airflow front outlets 60 and upward across the user's face and up and over the user's head, and out the top of the hood worn over the helmet 12.

Figure 2:
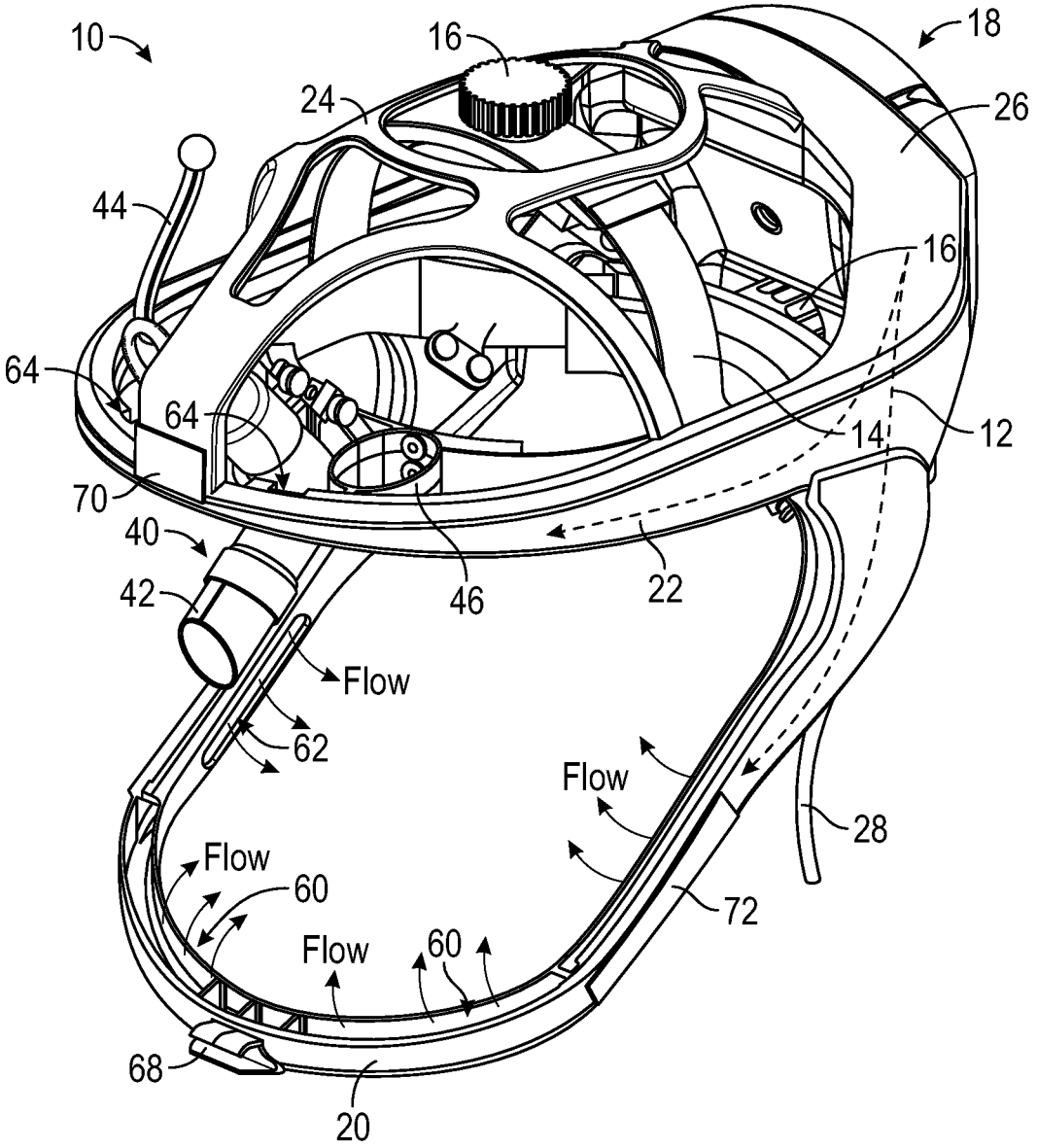
FIG. 2 is a perspective view toward the left side of the surgical helmet assembly of FIG. 1.
Figure 11:
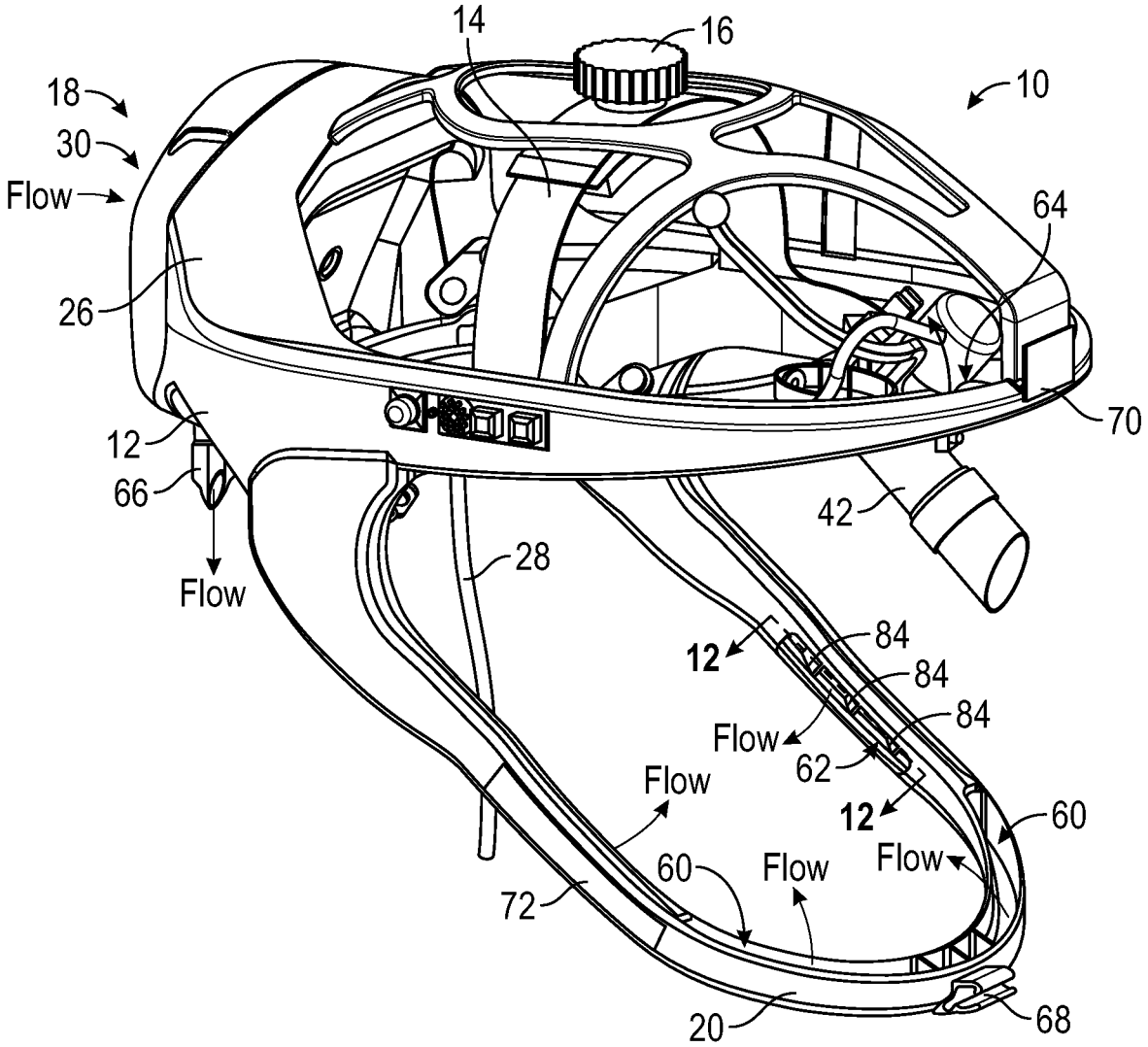
FIG. 11 is a perspective view of the surgical helmet assembly of FIG. 1 illustrating airflow pathways through the components of the surgical helmet assembly.

FIG. 11 illustrates one of the chin bar airflow side outlets 62 in the side of the chin bar 20 configured to face the left side of a user's head. It is noted that the chin bar airflow side outlet 62 on the other side of the chin bar 20 configured to face the right side of a user's head may be similarly configured (FIG. 2). As can be seen in FIG. 11, the chin bar 20 may include one or more, or a plurality of airflow deflectors 84 extending across and partially obstructing the airflow passage 80 through the chin bar 20 to redirect a portion of the airflow through the airflow passage 80 out of the opening of the side outlets 62 while permitting a portion of the airflow to continue forward through the airflow passage 80 to the front outlets 60 in the chin bar 20. In some instances, the chin bar 20 may include one, two, three or more airflow deflectors 84. Similar airflow detectors may be included at other outlets, if desired. Any of the airflow deflectors disclosed herein may pivot relative to surrounding structures to regulate the amount and/or direction of airflow out of a given outlet.

Figure 12:
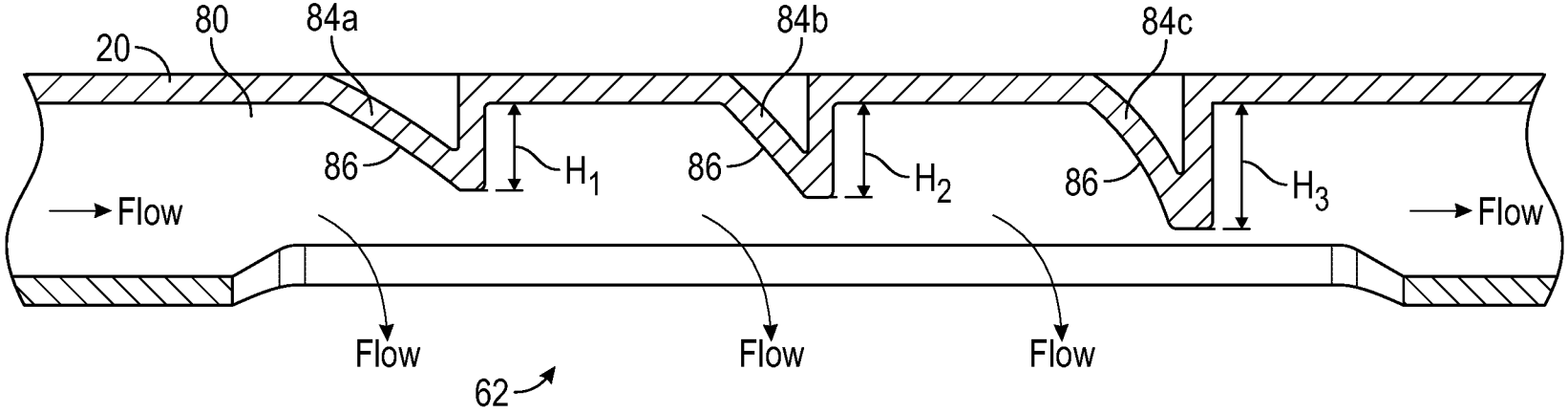
FIG. 12 is a cross-sectional view taken along line 12-12 of FIG. 11 illustrating airflow deflectors within the airflow pathways of the surgical helmet assembly.

FIG. 12, which is a cross-sectional view taken along line 12-12 of FIG. 11, illustrates one exemplary configuration of airflow deflectors 84 extending into and partially obstructing the airflow passage 80 through the chin bar 20 at the airflow side outlet 62. The airflow deflectors 84 may be formed as a monolithic portion of the chin bar 20, or the airflow deflectors 84 may be formed as a separate component secured to the chin bar 20, if desired. The airflow deflectors 84, as shown in FIG. 12, may include an angled or ramped surface 86 against which the airflow may impinge and be redirected out of the opening of the airflow side outlet 62. In some instance, the ramped surface 86 may be a planar surface or an arcuate (e.g., concave) surface extending from a wall of the chin bar 20 into the airflow passage 80. For example, the ramped surface 86 may extend from a wall of the chin bar 20 opposite the opening of the airflow side outlet 62 toward the opening of the airflow side outlet 62.

In some instances in which the chin bar 20 includes multiple airflow deflectors 84, the airflow deflectors may be sized and/or configured to progressively extend from an interior wall of the chin bar 20 into the airflow passage 80 to different heights. For example, each progressive airflow deflector 84 may extend further across the airflow passage 80 than a preceding airflow deflector 84 in the direction of the airflow (i.e., in a forward direction toward the front of the helmet assembly 10). For example, a first or rearwardmost airflow deflector 84*a* may have a first height $H_1$ such that the first airflow deflector 84*a* extends across or into the airflow passage 80 a first distance, a second or intermediate airflow deflector 84*b* may have a second height $H_2$ greater than the first height $H_1$ such that the second airflow deflector 84*b* extends across or into the airflow passage 80 a second distance greater than the first distance, and a third or forwardmost airflow deflector 84*c* may have a third height $H_3$ greater than the second height $H_2$ such that the third airflow deflector 84*c* extends across or into the airflow passage 80 a third distance greater than the second distance. Accordingly, the height of the airflow deflectors 84 may progressively increase, such that an airflow deflector 84 located at a downstream location relative to one or more airflow deflectors 84 may have a height greater than the airflow deflector(s) 84 located at the upstream location(s).

The airflow deflectors 84*a*, 84*b*, 84*c* may divert or redirect a portion of the airflow F passing through the airflow passage 80 out through the opening of the airflow side outlets 62 while a portion of the airflow F passing through the airflow passage 80 may continue through the airflow passage 80 forward of the airflow side outlets 62 to the airflow front outlets 60 in the chin bar 20.

Figure 12A:
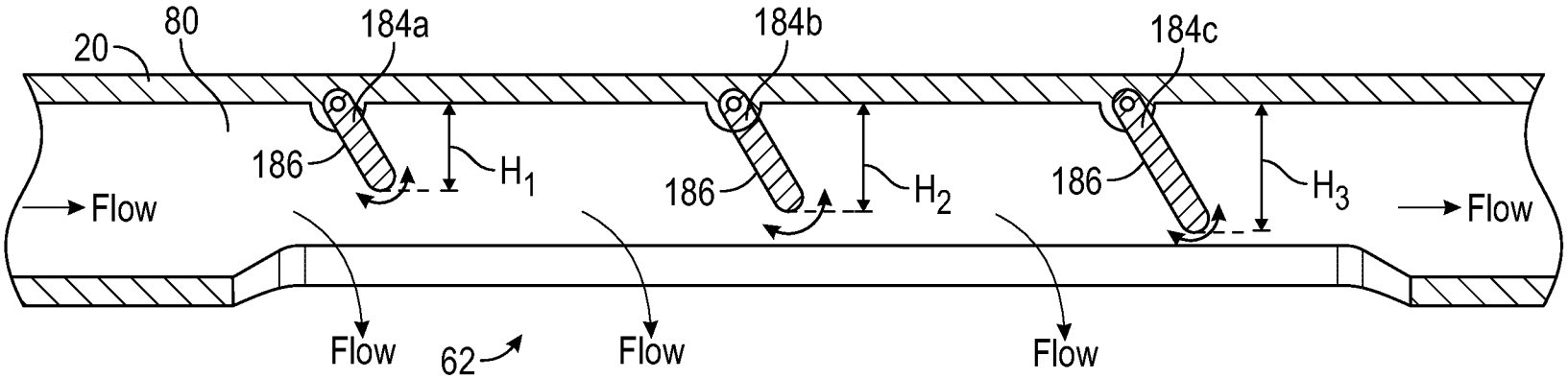
FIG. 12A is a cross-sectional view illustrating an alternative configuration of airflow deflectors within the airflow pathways of the surgical helmet assembly.

FIG. 12A is a cross-sectional view of an alternative configuration of airflow deflectors 184 extending into and partially obstructing the airflow passage 80 through the chin bar 20 at the airflow side outlet 62. The airflow deflectors 184 may pivot relative to the chin bar 20 to regulate the amount and/or direction of airflow out of the airflow side outlet 62. For example, the airflow deflectors 184 may be pivotably coupled to the chin bar 20 with a pivot pin or post.

The airflow deflectors 184, as shown in FIG. 12A, may include an angled or ramped surface 186 against which the airflow may impinge and be redirected out of the opening of the airflow side outlet 62. In some instance, the ramped surface 186 may be a planar surface or an arcuate (e.g., concave) surface extending from a wall of the chin bar 20 into the airflow passage 80. For example, the ramped surface 186 may extend from a wall of the chin bar 20 opposite the opening of the airflow side outlet 62 toward the opening of the airflow side outlet 62.

In some instances in which the chin bar 20 includes multiple airflow deflectors 184, the airflow deflectors may be sized and/or configured to progressively extend from an interior wall of the chin bar 20 into the airflow passage 80 to different heights. For example, each progressive airflow deflector 184 may extend further across the airflow passage 80 than a preceding airflow deflector 184 in the direction of the airflow (i.e., in a forward direction toward the front of the helmet assembly 10). For example, a first or rearwardmost airflow deflector 184*a* may have a first height $H_1$ such that the first airflow deflector 184*a* extends across or into the airflow passage 80 a first distance, a second or intermediate airflow deflector 184*b* may have a second height $H_2$ greater than the first height $H_1$ such that the second airflow deflector 184*b* extends across or into the airflow passage 80 a second distance greater than the first distance, and a third or forwardmost airflow deflector 184*c* may have a third height $H_3$ greater than the second height $H_2$ such that the third airflow deflector 184*c* extends across or into the airflow passage 80 a third distance greater than the second distance. Accordingly, the height of the airflow deflectors 184 may progressively increase, such that an airflow deflector 184 located at a downstream location relative to one or more airflow deflectors 184 may have a height greater than the airflow deflector(s) 184 located at the upstream location(s).

The airflow deflectors 184*a*, 184*b*, 184*c* may divert or redirect a portion of the airflow F passing through the airflow passage 80 out through the opening of the airflow side outlets 62 while a portion of the airflow F passing through the airflow passage 80 may continue through the airflow passage 80 forward of the airflow side outlets 62 to the airflow front outlets 60 in the chin bar 20.

An exemplary airflow pattern F is illustrated by arrows shown in FIGS. 1, 2 and 11. As shown in the figures, the fan 32 may draw ambient air into the airflow inlet chamber 38 through the airflow inlet 30 at the rear of the helmet assembly 10 and push the air through the airflow passage 80 within the chin bar 20 and/or through the airflow passage 82 within the brow bar 22 such that air may exit out the outlets 60, 62, 64. The fan 32 may additionally push the air out of the nozzles 66 at the rear of the helmet assembly 10 located above the headband opening. Accordingly, the ventilation system may circulate ambient air upward past the user's face and over the user's head to exit through the top of the helmet 12.

The surgical helmet assembly 10 may be configured such that any desired portion of the airflow is directed out the various outlets. For example, about 15-25% of the airflow may exit from the at least one airflow front outlet 60 in the chin bar 20 (e.g., about 7.5-12.5% through each of the two illustrated chin bar front airflow outlets 60), about 10-20% of the airflow may exit from the at least one airflow outlet in the brow bar (e.g., about 5-10% through each of the two illustrated brow bar airflow outlets 64), about 25-35% of the airflow may exit from the first and second airflow side outlets in the chin bar (e.g., about 12.5-17.5% through each of the two illustrated chin bar side airflow outlets 62), and about 25-35% of the airflow may exit from the first and second rear nozzles (e.g., about 12.5-17.5% through each of the two illustrated rear nozzles 66). However, in other instances other airflow distribution is contemplated.

In one embodiment, about 20% of the airflow exits from the at least one airflow front outlet 60 in the chin bar 20 (e.g., about 10% through each of the two illustrated chin bar front airflow outlets 60), about 15% of the airflow exits from the at least one airflow outlet in the brow bar (e.g., about 7.5% through each of the two illustrated brow bar airflow outlets 64), about 32% of the airflow exits from the first and second airflow side outlets in the chin bar (e.g., about 16% through each of the two illustrated chin bar side airflow outlets 62), and about 33% of the airflow exits from the first and second rear nozzles (e.g., about 16.5% through each of the two illustrated rear nozzles 66).

Figure 14:
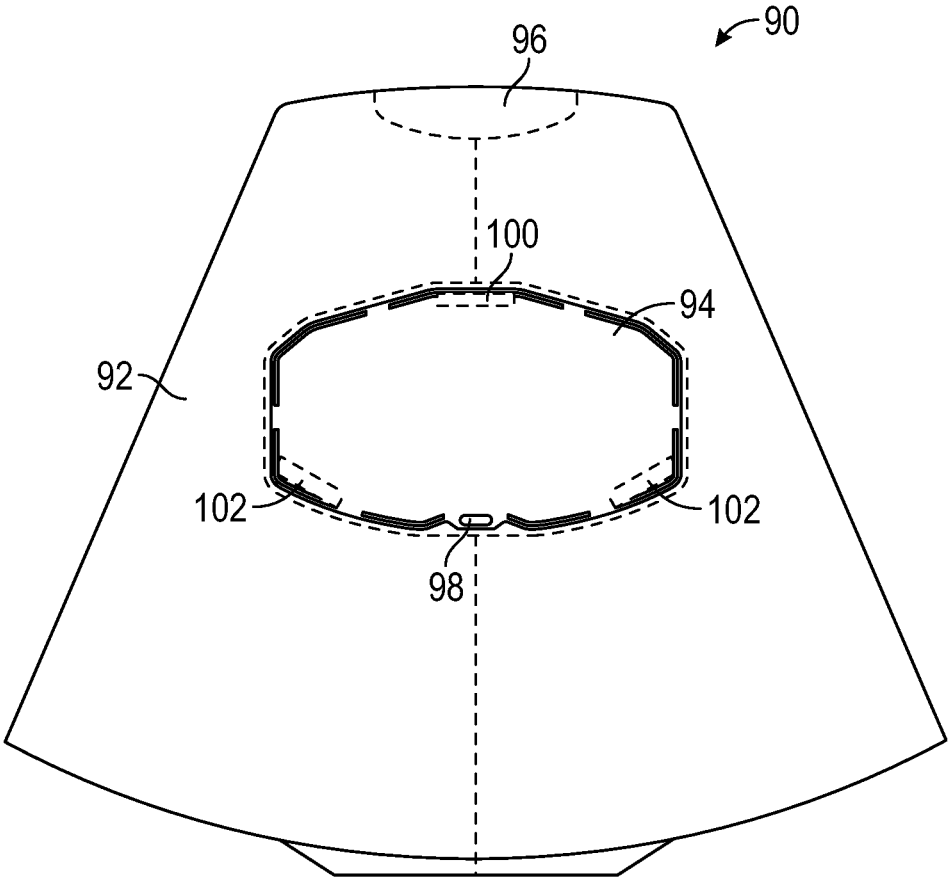
FIG. 14 illustrates an exemplary protective garment including a shield for use with the surgical helmet assembly of FIG. 1.
Figure 15:
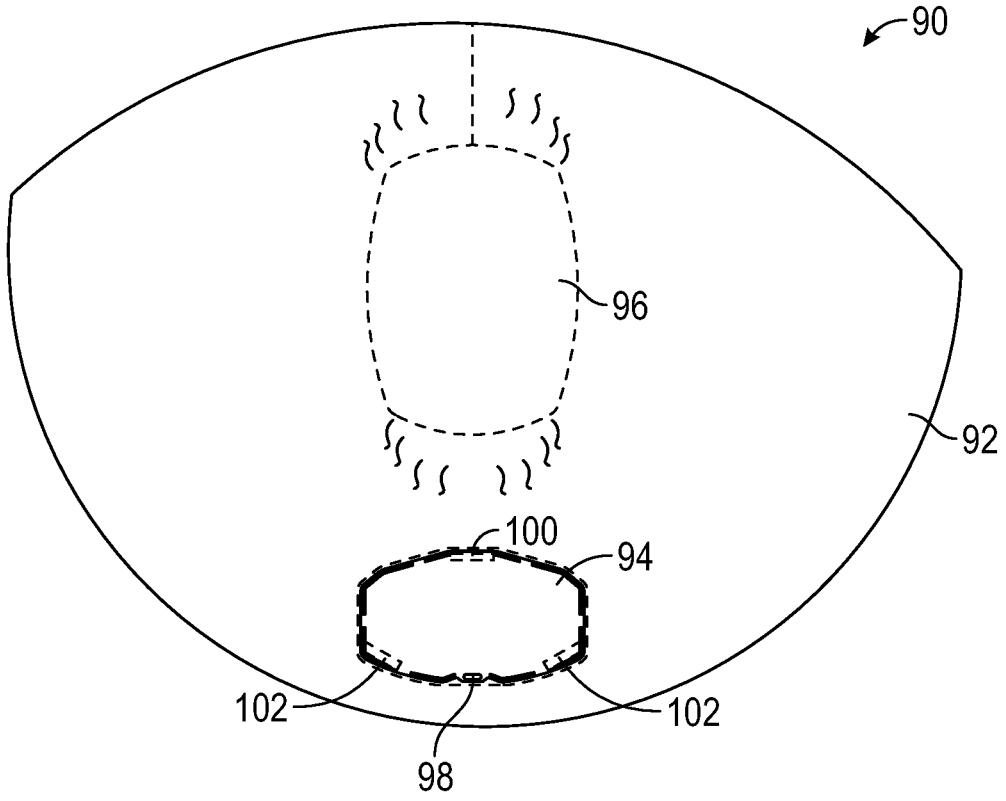
FIG. 15 is a top view of the exemplary protective garment of FIG. 14.

The surgical helmet assembly 10 may be used to support a protective garment, such as a surgical shield and hood and/or toga covering a portion of the medical personnel's head and/or body during a medical procedure. One exemplary protective garment 90 is shown in FIGS. 14 and 15.

The protective garment 90 may include a shield 94, such as a transparent shield, through which the user may view the surgical field while wearing the protective garment 90. The protective garment 90 may also include a hood and/or toga 92 attached to the shield 94 configured to cover a portion of the user's head and/or body. The hood and/or toga 92 may be a cloth or plastic covering, for example, providing a protective barrier between the user and the surgical field. Although the protective garment 90 is shown as a hood configured to cover the user's head, it is understood that in some instances the protective garment 90 may be a toga configured to additionally cover the user's arms, torso, and/or legs as well, if desired. It is understood that a toga may include a hood configured to cover the user's head, similar to that shown in FIGS. 14-15.

The protective garment 90 may include a filter 96 formed of a permeable material allowing air to flow through the filter 96. The filter 96 may be stitched, glued or otherwise secured to the cloth or plastic material forming the hood 92. The filter 96 may be arranged such that the filter 96 is positioned above the head of the user when the protective garment 90 is worn by the user. Thus, the filter 96 may be positioned above the open top of the helmet 12, allowing the air circulated past the user's head to pass out through the filter 96 to the ambient environment.

The protective garment 90 may include securement features configured to secure the protective garment 90 to the surgical helmet assembly 10. For example, the shield 94 may include a tab 98 at a lower edge of the shield 94 configured to engage a clip 68 extending from the chin bar 20 of the helmet assembly 10. The link between the tab 98 and the clip 68 includes clearance such that there is some variance in the connection of the two components. One exemplary clip 68 is illustrated in FIGS. 1-4. The clip 68 may include first and second arms extending from the chin bar 20, configured to receive the tab 98 of the shield 94 therebetween. The clip 68 may include a label or marker to label or mark its location.

The protective garment 90 may also include securement features configured to engage mating securement features on the opposing sides of the chin bar 20 and/or the brow bar 22, for example. For instance, the protective garment 90 may include a securement feature, such as a piece of hook-and-loop material 100 (e.g., Velcro®) at an upper edge of the shield 94 (e.g., on an inner face of the shield 94 configured to face the user's face) configured to be secured to a securement feature on the brow bar 22, such as a complementary piece of hook-and-loop material 70 (e.g. Velcro®) located on the front of the brow bar 22 (see, e.g., FIGS. 1 and 2). Additionally or alternatively, the protective garment 90 may include securement features, such as pieces of hook-and-loop material 102 (e.g., Velcro®) positioned along the edge of the shield 94 (e.g., on an inner face of the shield 94 configured to face the user's face) on opposite sides of the tab 98 configured to be secured to securement features on opposing sides of the chin bar 20, such as complementary pieces of hook-and-loop material 72 (e.g. Velcro®) located along the first and second (e.g., right and left) sides of the chin bar 20 (see, e.g., FIGS. 1 and 2). In one illustrative embodiment, the hook-and-loop material 100, 102 provided with the protective garment 90 may be pieces of loop material and the hook-and-loop material 70, 72 provided with the helmet assembly 10 may be pieces of hook material. However, in other embodiments, the hook-and-loop material 100, 102 provided with the protective garment 90 may be pieces of hook material and the hook-and-loop material 70, 72 provided with the helmet assembly 10 may be pieces of loop material, for example. The hook-and-loop material 70, 72 100, 102 allows for a degree of misalignment of the shield 94 with the helmet assembly 10. Although the securement features are illustrated as mating pieces of hook-and-loop material, it is noted that in other embodiments, the securement features could be snaps, clasps, hooks, ties, magnets or other fasteners to attach the protective garment 90 to the helmet assembly 10. For example, magnets may be provided on one of the shield 94 and helmet assembly 10 to magnetically attach to mating magnets and/or metallic surfaces on the other of the shield 94 and helmet assembly 10.

Aspects of an exemplary donning or gowning procedure will now be described while referring to FIGS. 16 and 17. The user may initially place the helmet assembly 10 on the user's head and make any adjustments to the adjustable head band 14 to provide a desired fit of the helmet assembly on the user's head. The user may also make any electrical connections to a power source (e.g., a battery pack) to complete an electrical connection between the power source and the fan 32 and/or light assembly 40 of the helmet assembly 10.

Figure 16:
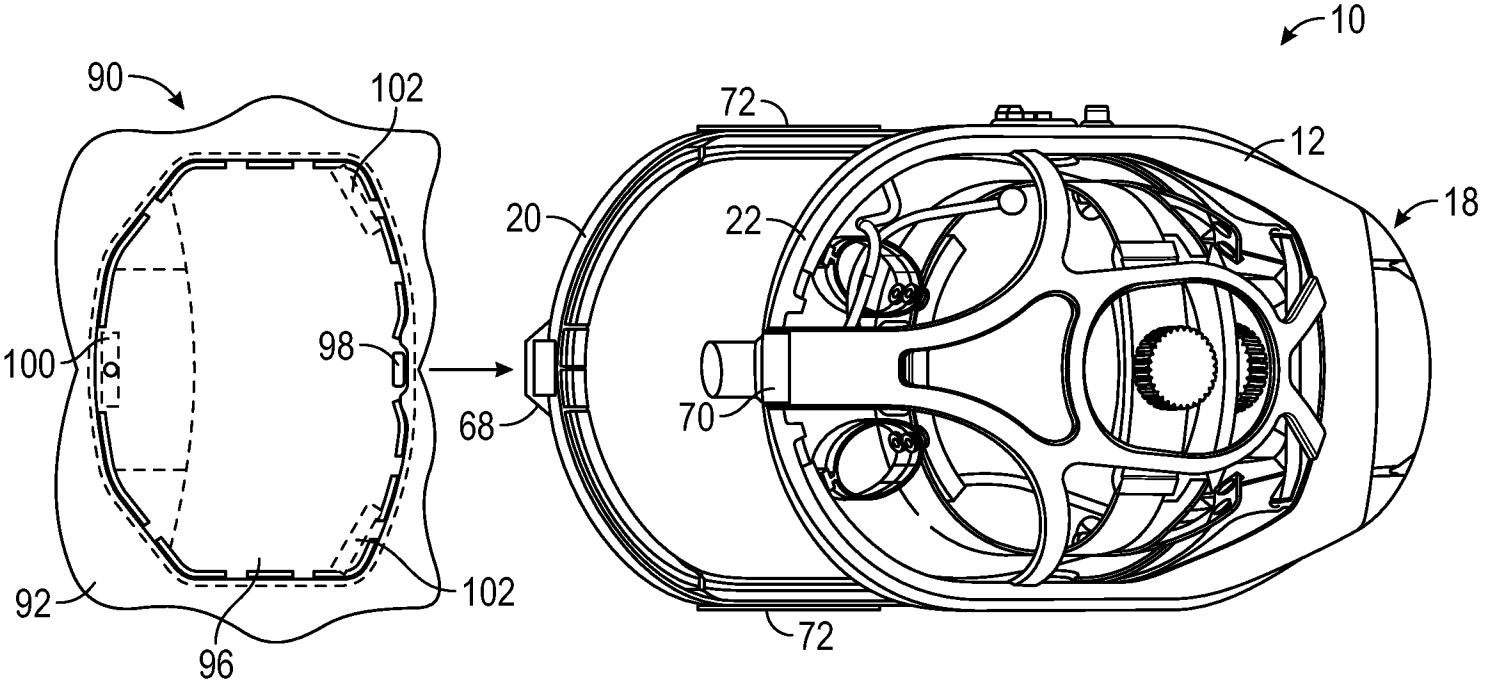
FIGS. 16-17 illustrate exemplary aspects of a donning procedure for the protective garment.

The protective garment 90 may then be removed from a sterilized package and oriented, as shown in FIG. 16, with the inner surface of the shield 94 (i.e., the side of the shield 94 configured to face the user's face) facing upward and the tab 98 of the shield 94 oriented toward the clip 68 on the chin bar 20. Another person assisting in the donning procedure may then insert the tab 98 into the slot between the arms of the clip 68 on the chin bar 20 of the helmet assembly 10 with one of the arms of the clip 68 extending through the opening in the shield 94 to couple the shield 92 to the chin bar 20.

With the tab 98 engaged with the clip 68, the person assisting in the donning procedure may then rotate the shield 94 toward the helmet 12 and the hook-and-loop material 100 at the upper edge of the shield 94 may be secured to the hook-and-loop material 70 at the front of the brow bar 22 of the helmet 12. The shield 94 may then be curved around the sides of the brow bar 22 and the chin bar 20 and the hook-and-loop material 102 on side portions of the shield 94 may be secured to the pieces of hook-and-loop material 72 on the sides of the chin bar 20.

With the shield 94 attached to the helmet assembly 10 at the attachment points (e.g., at the front of the chin bar 20, sides of the chin bar 20, and front of the brow bar 22), the person assisting in the donning procedure may pull the hood 92 of the garment 90 over the helmet assembly 10, and thus over the head of the user. The hood 92 may be pulled over the helmet assembly 10 such that the filter 96 is placed on top of the helmet assembly 10 and extends over the airflow inlet 30 at the rear of the helmet 12. The person assisting in the donning procedure may then unfold the hood 92 over the user's shoulders. In embodiments in which the protective garment 90 includes a toga with the hood 92, the toga may be unfolded around the user's torso and legs, and the user's arms may be inserted into the sleeves of the toga, for example.

FIG. 17 illustrates the protective garment 90, including the shield 94, secured to the helmet assembly 10 and worn over the user's head. As shown in FIG. 17, the filter 96 may be positioned over the top of the helmet assembly 10 covering the open lattice framework or open cage 24 of the helmet 12 and the airflow inlet 30 at the rear of the helmet 12. Furthermore, the chin bar 20 may extend from the surgical helmet 12 at a location rearward of the user's ears such that the chin bar 20 does not obstruct sound from traveling to the user's ears. Accordingly, the user's ears may only be covered by the fabric of the hood 92 rather than the chin bar 20 or the face shield 94. Sound may more easily pass through the fabric of the hood 92 than through or around the chin bar 20 and/or face shield 94 to the user's ears, improving the user's ability to hear while wearing the helmet assembly 10 and protective garment 90.

An exemplary airflow path F, denoted by arrows in FIG. 17, may be generated with the fan 32 at the rear of the helmet assembly 10. For example, the fan 32 may draw ambient air through the filter 96 and into the airflow inlet 30 at the rear of the helmet assembly 10 to the airflow inlet chamber 38 and push the air through the airflow passage 80 within the chin bar 20 and/or through the airflow passage 82 within the brow bar 22 such that air may exit out the outlets 60, 62, 64. The airflow F may exit the front chin bar airflow outlets 60 in the chin bar 20 in an upward direction across the shield 94 and the face of the user and upward over the head of the user. Furthermore, the airflow F may exit the brow bar airflow outlets 64 in the brow bar 22 in an upward direction over the user's head. After passing upward across the user's face and upward over the user's head, the air may be directed out the top of the helmet assembly 10, for example, out through the open lattice framework or open cage 14 and out of the protective garment 90 through the filter 96. The airflow F may also exit the side chin bar airflow outlets 62 from the airflow passage 80 in the chin bar 20 toward the face of the user (e.g., toward the cheeks of the user). The fan 32 may additionally push the air out the nozzles 66 at the rear of the helmet assembly 10 toward the user's neck. Accordingly, the ventilation system may circulate ambient air upward past the user's face and upward over the user's head to exit through the top of the helmet 12 through the filter 96. Directing the airflow F out the top of the helmet 12 allows fresh air to be continuously circulated around the user's face while wearing the helmet assembly 10 and associated protective garment 90 during a surgical procedure.

Figure 18:
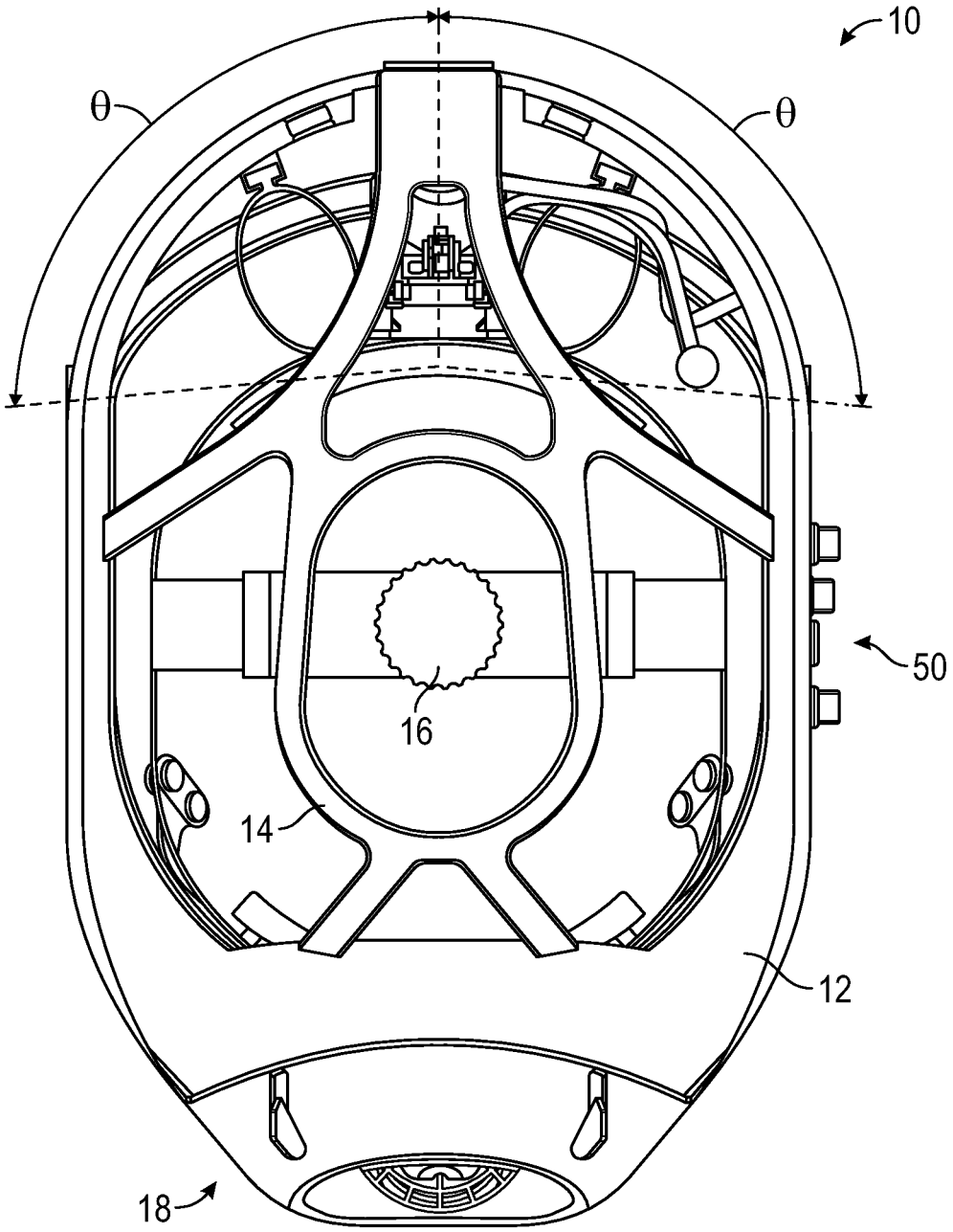
FIG. 18 is a top view illustrating an exemplary field of view of the surgical helmet assembly.

The configuration of the surgical helmet assembly 10 and shield 94 is designed to provide the user with a clear field of view of a surgical site. The large opening provided between the brow bar 22 and the chin bar 20 provides the user with a clear view of the surgical site and peripheries. For example, the viewable opening between the brow bar 22 and the chin bar 20 across which the shield 94 is positioned may have a width of at least 13.5 inches, at least 14 inches, or at least 15 inches, and may have a height of at least 7.5 inches, in some instances. Furthermore, as shown in FIG. 18, the viewable opening may provide the user with a viewing angle θ from the midline of the user's forehead (i.e., from the sagittal plane of the user) to each side of at least 90°, at least 95°, at least 100°, at least 105°, or at least 110°, in some instances. The overall field of view through the viewable opening may be at least 95 square inches or at least 100 square inches, for example. The viewable opening of the illustrated embodiment has a width of about 15.1 inches, a height of about 7.56 inches, and a viewing angle from the midline of the user's forehead of about 110°, with an overall field of view of about 100 square inches.

The surgical helmet assembly 10 and protective garment 90 may provide the user with a comfortable environment and sterile barrier while wearing the protective system. For example, the helmet assembly 10 may provide a secure fixation of the shield 94 and a comfortable airflow of fresh air upward across the user's face and over the user's head, which also prevents the shield 94 from fogging over while wearing the protective system. Furthermore, the viewable opening provides the user with a clear view of the surgical site and peripheries during the surgical procedure.

Those skilled in the art will recognize that aspects of the present disclosure may be manifested in a variety of forms other than the specific embodiments described and contemplated herein. Accordingly, departure in form and detail may be made without departing from the scope and spirit of the present disclosure as described in the appended claims.

What is claimed is:

1. A surgical helmet assembly, comprising:

an interchangeable protective garment comprising a shield and a covering, the shield adapted to be coupled to the covering, and the covering for providing a barrier between at least a head and shoulders of a user and a surgical field;

a surgical helmet to be worn on the head of the user, comprising:

a main helmet upper body comprising a non-airflow conducting cage structure positionable superior of the head of the user;

an elongate arcuate brow bar located below the main helmet upper body and having a length configured to extend medial-laterally across a forehead of the user between temple regions of the head of the user on both sides of the head and extend to rear regions of the head of the user on both sides of the head;

an arcuate chin bar configured to be disposed anterior of a chin of the user and extend from a portion of the main helmet upper body superior and posterior of the user's ears and pass posterior of the user's ears to the brow bar in use so the chin bar leaves the user's ears uncovered laterally when the covering of the interchangeable protective garment is removed, the chin bar comprising an anterior airflow outlet disposed in an upper surface of an anterior portion of the chin bar and an airflow channel extending from rear regions of the brow bar through the arcuate chin bar from superior and posterior of the user's ears to the anterior airflow outlet;

hook-and-loop material anchors located on the brow bar and the chin bar and positioned to attach to mating hook-and-loop material anchors on the shield;

a fan mounted to the surgical helmet at the rear regions of the brow bar above the brow bar and the arcuate chin bar;

a front airflow outlet positioned to receive air from the fan via the brow bar and configured to discharge airflow onto the forehead of the user;

a rear airflow outlet positioned to receive air from the fan and configured to discharge airflow onto the neck of the user; and an airflow inlet located in an inlet cover mounted to the fan;

wherein the airflow channel is structured such that the airflow inlet and the anterior airflow outlet are in direct fluidic communication with each other so that the fan draws air through the airflow inlet and then pushes the air downward through the airflow channel and the brow bar and then out through the anterior airflow outlet of the chin bar and front airflow outlet of the brow bar; and a light assembly comprising:

a light source mounted to the surgical helmet in an articulable manner; and an adjustment arm connected to the light source to articulate the light source between a first position and a second position, the adjustment arm comprising a single lever directly connecting the light source to a knob positioned outside of the cage structure.

2. The surgical helmet assembly of claim 1, wherein the chin bar further comprises a first side airflow outlet disposed in a first side surface of the chin bar and a second side airflow outlet disposed in an opposed second side surface of the chin bar.

3. The surgical helmet assembly of claim 2, wherein each of the first side airflow outlet and the second side airflow outlet in the chin bar comprise an airflow deflector that extends across a portion of the airflow channel and is adapted to deflect a portion of the air passing therethrough out of the respective one of the first side airflow outlet and the second side airflow outlet towards a respective one of the user's cheeks.

4. The surgical helmet assembly of claim 3, wherein the airflow deflector comprises a first airflow deflector and a second airflow deflector; and wherein the second airflow deflector extends across the airflow channel to a greater extent than the first airflow deflector.

5. The surgical helmet assembly of claim 3, wherein the airflow deflectors are pivotably coupled to the chin bar.

6. The surgical helmet assembly of claim 1, wherein the anterior airflow outlet in the chin bar comprises a first front airflow outlet and second front airflow outlet.

7. The surgical helmet assembly of claim 6, wherein the first front airflow outlet and the second front airflow outlet are separated by a partition located at an anterior-most point of the chin bar.

8. The surgical helmet assembly of claim 1, wherein the the lever extends from the light source at a first end, through the cage structure and to the knob at a second end that that is displaced away from the main upper helmet body such that no portion of the knob is in direct contact with any portion of the cage structure.

9. A surgical helmet assembly, comprising:

an interchangeable protective garment comprising a shield and a covering, the shield adapted to be coupled to the covering, and the covering for providing a barrier between at least the head and shoulders of a user and a surgical field; and a surgical helmet to be worn on the head of the user, comprising:

a main helmet body positionable superior of the head of the user and comprising an elongate arcuate brow bar having a length configured to extend medial-laterally across the forehead of the user, the brow bar comprising a medial-laterally extending airflow channel extending therethrough, and a brow airflow outlet disposed therein configured to emit airflow across the forehead of the user;

a fan mounted at a rear of the brow bar above the brow bar;

an articulating light source mounted to a front of the brow bar, the articulating light source including a light housing configured to articulate within a sagittal plane located at a center of the head of the user when the surgical helmet is worn by the user;

an adjustment arm extending from the light housing to facilitate articulation of the articulating light source from above the main helmet body, the adjustment arm comprising a single lever directly coupled to the light source and directly coupled to a knob at a terminal end of the single lever;

a rear airflow outlet positioned to receive air from the fan and configured to discharge airflow onto the neck of the user; and an airflow inlet;

wherein the medial-laterally extending airflow channel is structured so that the fan draws air through the airflow inlet and then pushes the air downward into the brow bar and through the medial-laterally extending airflow channel and then out through the brow airflow outlet.

10. The surgical helmet assembly of claim 9, further comprising:

an arcuate chin bar configured to be disposed anterior of a chin of the user and extend from a portion of the main helmet body superior and posterior of the user's ears in use so the chin bar leaves the user's ears uncovered and pass posterior of the user's ears in use so the chin bar leaves the user's ears uncovered laterally when the covering of the interchangeable protective garment is removed, the chin bar comprising an anterior airflow outlet disposed in an upper surface of an anterior portion of the chin bar and an airflow channel extending through the arcuate chin bar from superior and posterior the user's ears to the anterior airflow outlet, the chin bar having a pair of arms extending outwardly from an anterior-most surface thereof for receiving a tab associated with the interchangeable protective garment.

11. The surgical helmet assembly of claim 10, wherein the chin bar further comprises a first side airflow outlet disposed in a first side surface of the chin bar and second side airflow outlet disposed on an opposed second side surface of the chin bar, wherein each of the first side airflow outlet and the second side airflow outlet in the chin bar comprise an airflow deflector that extends across a portion of the airflow channel and is adapted to deflect a portion of the air passing therethrough out of the respective one of the first side airflow outlet and the second side airflow outlet towards a respective one of the user's cheeks.

12. The surgical helmet assembly of claim 9, further comprising:

a first piece of hook-and-loop fastener material located at an anterior surface of the brow bar; and a second piece of hook-and-loop fastener material located at a posterior surface of the shield in position to engage the first piece of hook-and-loop fastener material to couple the shield to the surgical helmet.

13. The surgical helmet assembly of claim 12, further comprising:

a first segment of a chin bar adapted to extend inferiorly from the brow bar proximate a first ear of the user;

a second segment of the chin bar adapted to extend inferiorly from the brow bar opposite the first segment proximate a second ear of the user;

a third piece of hook-and-loop fastener material located on the first segment of the chin bar; and a fourth piece of hook-and-loop fastener material located on the second segment of the chin bar.

14. The surgical helmet assembly of claim 9, wherein the light source is mounted to a medial-lateral center of the brow bar and emits a single light beam that is bifurcated by the sagittal plane.

15. The surgical helmet assembly of claim 9, wherein the brow airflow outlet includes openings in an upper surface of the brow bar configured to emit airflow in an anatomically superior direction.

16. The surgical helmet assembly of claim 9, further comprising;

a linkage extending between the main helmet body and the light housing for pivoting the articulating light source; and wherein the single lever is made from a material such that articulation of the single lever in forward and backward directions directly results in movement of the light source along the central sagittal plane.

17. A surgical helmet assembly comprising:

a surgical helmet to be worn on a head of a user, comprising:

a main helmet body positionable superior of the head of the user and comprising an elongate arcuate brow bar having a length configured to extend medial-laterally across the forehead of the user, the brow bar comprising an airflow channel extending therethrough and, a brow airflow outlet disposed therein;

first and second chin bar segments extending in an inferior direction from a portion of the main helmet body;

first, second and third segments of hook-and-loop material positioned on the arcuate brow bar, the first chin bar segment and the second chin bar segment, respectively;

a light source coupled to the elongate arcuate brow bar at an articulable connection including an adjustment arm configured to actuate the light source along a central sagittal plane of the surgical helmet assembly such that a center of a light beam emitted from the light source shines along the central sagittal plane, the adjustment arm comprising a single lever directly coupled to the light source and directly coupled to a knob;

a fan coupled to the main helmet body; and an airflow inlet positioned on the main helmet body so that the fan draws in air through the airflow inlet and pushes air into the elongate arcuate brow bar; and an interchangeable protective garment comprising:

a shield;

a covering; and fourth, fifth and sixth segments of hook-and-loop material;

a filter positioned adjacent the airflow inlet;

wherein the shield is adapted to be coupled to the covering and the fourth, fifth and sixth segments of hook-and-loop material are positioned to mate with the first, second and third segments of hook-and-loop material, respectively, the covering for providing a barrier between at least the head and shoulders of the user and a surgical field, wherein the filter is positionable over the main helmet body; and wherein the airflow channel is structured such that the airflow inlet and the brow airflow outlet are in direct fluidic communication with each other so that the fan draws air through the airflow inlet and then pushes the air through the airflow channel and then out through the brow airflow outlet.

18. The surgical helmet assembly of claim 17, further comprising a first side airflow outlet and a second side airflow outlet in the chin bar that each comprise an airflow deflector that extends across a portion of the airflow channel and is adapted to deflect a portion of the air passing therethrough out of the respective one of the first side airflow outlet and second side airflow outlet towards a respective one of the user's cheeks.

19. The surgical helmet assembly of claim 17, wherein the shield has a tab extending therefrom that is engageable with a pair of arms extending outwardly from a forwardmost surface of the chin bar, wherein the shield is coupleable to the chin bar via the tab and further coupleable to the brow bar.

20. The surgical helmet assembly of claim 17, wherein the knob is positioned at an exterior of the main helmet body such that no portion of the knob is in direct contact with the any portion of the main helmet body.

* * * * *